United States Patent [19]

Nawa et al.

[11] 4,326,452

[45] Apr. 27, 1982

[54] FLUID DIVERTING ASSEMBLY

[75] Inventors: Motoyuki Nawa; Norio Sugawara; Yutaka Takahashi, all of Nara, Japan

[73] Assignee: Matsushita Electric Industrial Co., Ltd., Kadoma, Japan

[21] Appl. No.: 953,968

[22] Filed: Oct. 19, 1978

[30] Foreign Application Priority Data

| | | | |
|---|---|---|---|
| Oct. 24, 1977 | [JP] | Japan | 52-128035 |
| Oct. 24, 1977 | [JP] | Japan | 52-128036 |
| Oct. 24, 1977 | [JP] | Japan | 52-128038 |
| Nov. 8, 1977 | [JP] | Japan | 52-134216 |
| Aug. 31, 1978 | [JP] | Japan | 53-107129 |
| Aug. 31, 1978 | [JP] | Japan | 53-107131 |
| Aug. 31, 1978 | [JP] | Japan | 53-107138 |

[51] Int. Cl.[3] ..... F24F 7/00; B05B 1/14

[52] U.S. Cl. ..... 98/40 VT; 236/49; 239/590; 239/590.5; 137/829

[58] Field of Search ..... 98/40 VT, 40 V, 94 AC, 98/40 R, 40 VM, 107, 108, 110, 114, 121 R; 239/265.27, 499, 513, 590, 590.5, DIG. 7; 34/229, 231; 137/829; 236/49; 62/186, 407

[56] References Cited

U.S. PATENT DOCUMENTS

| | | | |
|---|---|---|---|
| 1,781,266 | 11/1930 | Bruni | 181/186 |
| 1,918,927 | 7/1933 | Otto | 98/40 N |
| 3,102,389 | 9/1963 | Pedersen et al. | 239/265.27 |
| 3,174,422 | 3/1965 | Banko et al. | 98/40 VT |

FOREIGN PATENT DOCUMENTS

| | | | |
|---|---|---|---|
| 1805475 | 5/1970 | Fed. Rep. of Germany | 98/40 VT |
| 25055 | of 1906 | United Kingdom | 181/186 |

*Primary Examiner*—Henry C. Yuen
*Assistant Examiner*—Henry Bennett
*Attorney, Agent, or Firm*—Wenderoth, Lind & Ponack

[57] ABSTRACT

A fluid diverting assembly particularly suited for use as a component for a fluid exit structure of an air-conditioner, which has a passageway through which a fluid medium flows. The passageway includes a nozzle for issuing a fluid stream as the fluid medium passes therethrough, a pair of spaced opposed guide walls having a shape diverging from each other in a direction downstream with respect to the direction of flow of the fluid stream and opening outwardly in a direction away from the nozzle, and a deflecting blade supported in the passageway between the upstream and downstream ends of the nozzle for movement between first and second extreme positions for changing the direction of flow of the fluid stream emerging from the passageway in such a manner as to control mutual interference between one of currents flowing on one side of the deflecting blade and the adjacent guide wall thereby controlling the direction of flow of the fluid stream.

23 Claims, 28 Drawing Figures

FLUID DIVERTING ASSEMBLY

The present invention generally relates to a fluid diverting assembly and, more particularly, to a fluid diverting assembly, having a construction capable of diverting a fluid medium in any desired direction at a relatively wide angle of deflection.

The fluid medium with which the fluid diverting assembly according to the present invention operates includes either gas or liquid. However the fluid diverting assembly according to the present invention, although not limited thereto, is particularly applicable to an air conditioner which is required to have a construction wherein a stream of air, either hot or cool, is required to flow at a relatively wide angle of deflection towards a space to be air-conditioned in such a manner as to flow in any desired direction if necessary. In this application, the fluid diverting assembly according to the present invention may either be installed at an exit opening or grill of an indoor unit of the air-conditioner, through which the stream of air emerges towards the space to be air-conditioned, or constitute a part of the exit arrangement of the air conditioner.

Other applications of the present invention include a water sprinkler and a fluid logic element utilizing either gas or liquid, as will readily be understood by those skilled in the art from the description of the present invention.

There is known a wall adherence type fluid logic element wherein the wall adherence phenomenon is utilized in changing the direction of flow of a fluid medium. With this fluid logic element, if a relatively wide angle of deflection is desired, the length of the fluid logic element must be five to six times the width of the nozzle through which a fluid stream is issued.

Moreover, with the fluid logic element of the type referred to above, a continuous control of the direction of flow of the fluid stream can hardly be achieved.

There is also known a fluid diverting assembly of a type utilizing a plurality of louver blades for deflecting the direction of flow of the fluid stream emerging outwardly therethrough. In this known fluid diverting assembly, in order to achieve the deflection of flow of the fluid stream, the fluid stream must impinge upon the louver blades and, therefore, a considerable reduction in flow rate may take place when a relatively wide angle of deflection is to be achieved.

Other similar apparatus wherein the deflection of flow of the fluid stream is effected, but which are believed to be less material to the present invention, are disclosed, for example, in the U.S. Pat. Nos. 2,702,986, patented on Mar. 1, 1955; 2,825,204, patented on Mar. 4, 1958; 3,102,389, patented on Sept. 3, 1963; and 3,209,775, patented on Oct. 5, 1965.

Accordingly, an essential object of the present invention is to provide an improved fluid diverting assembly of a type comprising a passageway through which a fluid medium flows in one direction, a nozzle installed in the passageway and a pair of spaced opposed guide walls having a shape diverging from each other and a blade installed between the upstream and downstream ends of the nozzle for dividing the flow into two currents at the exit of the nozzle, one of the currents being diverted into mutual interference with the corresponding guide wall by the movement of the blade whereby the deflection of flow of the fluid can be controlled.

Another object of the present invention is to provide an improved fluid diverting assembly wherein the angle of deflection of the fluid stream can continuously be controlled.

A further object of the present invention is to provide an improved fluid diverting assembly of the type referred to above, which has a length equal to or smaller than the width of a nozzle and which can achieve a relatively wide angle of deflection of flow of the fluid stream.

A still further object of the present invention is to provide an improved fluid diverting assembly of the type referred to above, wherein the guide walls are curved in a direction outwardly diverging from each other for improving the continuous deflection control.

A still further object of the present invention is to provide an improved fluid diverting assembly, wherein outer portions of the respective guide walls are straight and flat for improving the stability of flow of the fluid stream at the time of the maximum angle of deflection.

A still further object of the present invention is to provide an improved fluid diverting assembly, wherein deflecting blade is employed which is an elongated rectangular plate so that the assembly can easily be manufactured.

A still further object of the present invention is to provide an improved fluid diverting assembly of the type referred to above, wherein the nozzle is defined by a pair of opposed ridge members and wherein there is formed a step between the nozzle defining ridge members and the adjacent guide walls for avoiding any possible wall adherence of the fluid stream, emerging through the nozzle, only when the deflecting blade is held at such a position as to direct the fluid stream to flow in direction intermediate between the direction of flow of the fluid stream along one of the guide walls and the direction of flow of the fluid stream along the other of the guide walls.

A still further object of the present invention is to provide an improved fluid diverting assembly of the type referred to above, wherein the upstream edge portion of the deflecting blade with respect to the nozzle is deformed to enable the fluid stream to be deflected at a relatively wide angle with a slight displacement of the deflecting blade.

A still further object of the present invention is to provide an improved fluid diverting assembly of the type referred to above, wherein a downstream edge portion of the deflecting blade with respect to the nozzle is deformed for enhancing the wall adherence of the fluid stream by reducing the width of a current of the fluid medium flowing between the deflecting blade and one of the guide walls so that the fluid stream emerging through the nozzle can be deflected at a relatively wide angle determined by the shape of the deflecting blade.

A still further object of the present invention is to provide an improved fluid diverting assembly of the type referred to above, wherein means is provided for detecting a change in temperature of the fluid stream for effecting a deflection of flow of the fluid stream automatically.

It is a related object of the present invention to provide an air-conditioning apparatus having the fluid diverting assembly of the type referred to above incorporated therein.

These and other objects and features of the present invention will become apparent from the following description taken in conjunction with the accompanying drawings, in which.

Before the description of the present invention proceeds, it is to be noted that like parts are designated by like reference numerals throughout the accompanying drawings.

Figure 1:
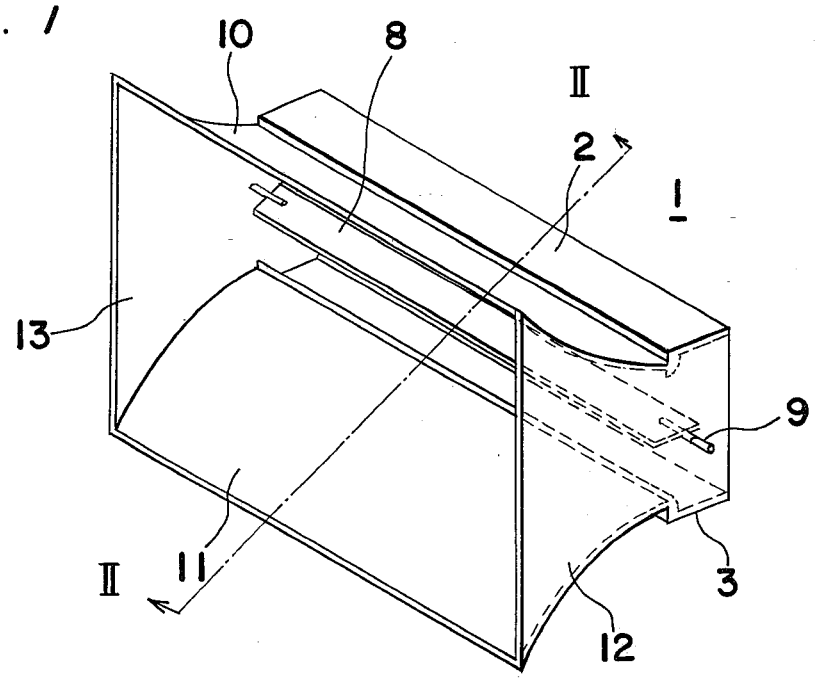
FIG. 1 is a schematic perspective view of a fluid diverting assembly according to one preferred embodiment of the present invention.

Referring first to FIGS. 1 to 4, there is shown a fluid diverting assembly, generally designated by 1, according to a first preferred embodiment of the present invention. The fluid diverting assembly 1 comprises a pair of elongated upstream walls 2 and 3 having nozzle defining ridges 4 and 5 each protruding from one side edge of the corresponding upstream wall 2 or 3 in a direction at right angles to the plane of one surface of the upstream walls 2 and 3. The ridges 4 and 5, here shown integral with the upstream walls 2 and 3, protrude towards each other and terminate with the inner ends spaced a predetermined distance from each other to define a nozzle 7 between said ridges 4 and 5.

The fluid diverting assembly 1 further comprises a deflecting blade 8 and a pair of guide walls 10 and 11. The guide walls 10 and 11 are so shaped as to diverge from each other in a direction downstream with respect to the direction of flow of a stream of fluid through the nozzle 7, thereby opening outwardly in a direction away from the nozzle 7, and are spaced from each other at the upstream end a distance slightly greater than the width Ws of the nozzle 7. As illustrated, these guide walls 10 and 11 are outwardly curved in a direction away from each other to provide a fluid exit passage between said guide walls 10 and 11. The upstream walls 2 and 3 and guide walls 10 and 11 are assembled together by a pair of opposed, substantially horn-shaped end plates 12 and 13 rigidly secured to the opposite ends of the respective walls 2, 3, 10 and 11.

The deflecting blade 8 is rigidly mounted on a shaft 9 for rotation together with said shaft 9, said shaft 9 having its opposite end portions journalled to the respective end plates 12 and 13 so that the blade 8 can be adjustably pivoted about the longitudial axis of the shaft 9 between a first extreme position, in which the stream of fluid emerging from the nozzle 7 flows outwards through the fluid exit passage in a direction along the curved guide wall 11, and a second extreme position in which the stream of fluid emerging from the nozzle 7 flows outwards through the fluid exit passage in a direction along the curved guide wall 12, as will be described in more detail later. This blade 8 thus installed has its opposite edge portions located at the downstream and upstream ends of the nozzle 7 and is so designed as to divide the stream of fluid into two currents E and D at the downstream end of the nozzle 7, one passing through a channel between the ridge 4 and the blade 8 and the other passing through a channel between the ridge 5 and the blade 8.

It is to be noted that the opening 6 defined by the walls 2 and 3 and the end plates 12 and 13 at a position opposed to the nozzle 7 and remote from the guide walls 10 and 11 serves as a supply port which is in communication with a source of fluid to be passed through the fluid diverting assembly 1.

The operation of the fluid diverting assembly having the construction described above will now be described with particular reference to FIGS. 2 to 4.

Figure 2:
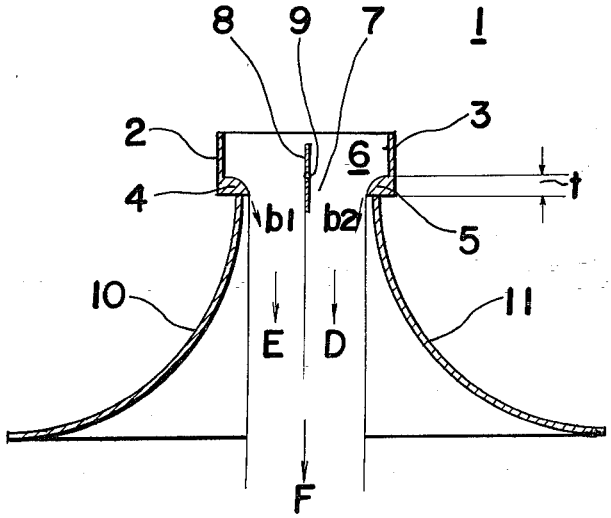
FIGS. 2 to 4 are cross sectional views taken along the line II—II in FIG. 1, showing the fluid deflecting blade in different operative positions.

Referring now to FIG. 2, the deflecting blade 8 is shown as assuming a position intermediate between the first and second extreme positions and wherein the blade 8 lies in a plane perpendicular to the transverse plane of the nozzle 7. In this condition of FIG. 2, the fluid currents D and E respectively flowing through the channel between the ridge 5 and the blade 8 and the channel between the ridge 4 and the blade 8 are in symmetrical relation with respect to the center plane which contains the longitudinal axis of the shaft 9 and passes at right angles to the transverse plane of the nozzle 7, this center plane being hereinafter referred to as the nozzle center plane. Accordingly, as the fluid flows through the nozzle 7, the fluid stream flowing through the nozzle 7 is contracted with components $b_1$ and $b_2$ tending to flow in a direction towards each other. However, these flow components $b_1$ and $b_2$ counteract each other and, therefore, the fluid stream as it emerges from the fluid diverting assembly 1 flows in a direction as shown by arrow F in FIG. 2.

Figure 3:
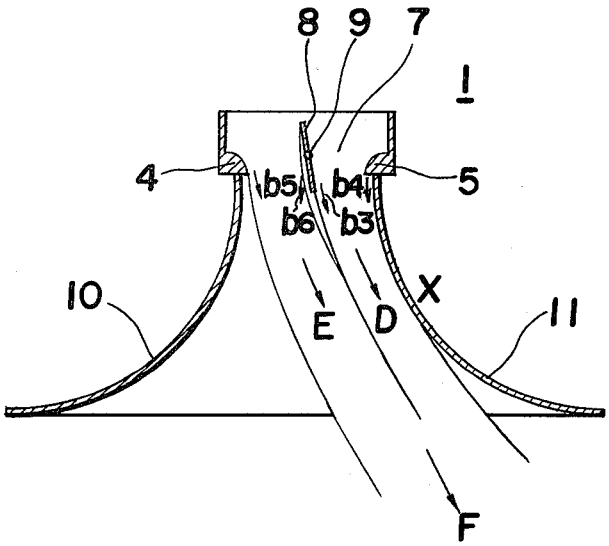

In FIG. 3, the deflecting blade 8 is shown as pivoted counterclockwise to a position substantially intermediate between the first extreme position and the position of the blade 8 shown in FIG. 2. In this condition, since the deflecting blade 8 protrudes to a position downstream of the nozzle 7, the current D flowing through the channel between the direction of flow of ridge 5 and the deflecting blade 8 is deflected due to the increased flow resistance imparted by the deflecting blade 8 at the downstream side of the nozzle 7. In other words, the flow component $b_4$ at the exit side of the nozzle defining ridge 5 is oriented inwardly of the nozzle center plane due to the contraction, but the deflecting force of the flow component $b_3$ along the deflecting blade 8 continues to act in a region downstream of the nozzle 7. Therefore, the current D, the direction of flow of which has been primarily determined by the position of the deflecting blade 8, contacts with the guide wall 11 and, subsequently, adheres to the guide wall 11 under the influence of the known Coanda effect. As the fluid continues to flow, the current D separates from the guide wall at a detachment point X and, thereafter, flows in a direction tangential to the detachment point X.

On the other hand, the current E flowing through the channel between the nozzle defining ridge 4 and the blade 8 has a flow component $b_6$ tending to flow substantially straight. However, the current E also has a flow component $b_5$ adjacent the nozzle defining ridge 4 which tends to flow inwardly of the nozzle center plane due to the contraction. By the action of the tendency of the flow component $b_5$ tending to flow in a direction rightwards as viewed in FIG. 3 and the tendency of the current D to attract the current E, the current E flows outwards in the direction of flow of the current D and subsequently joins the current D to provide the fluid stream flowing outwards from the fluid diverting assembly 1 in the direction as shown by arrow F in FIG. 3.

Figure 4:
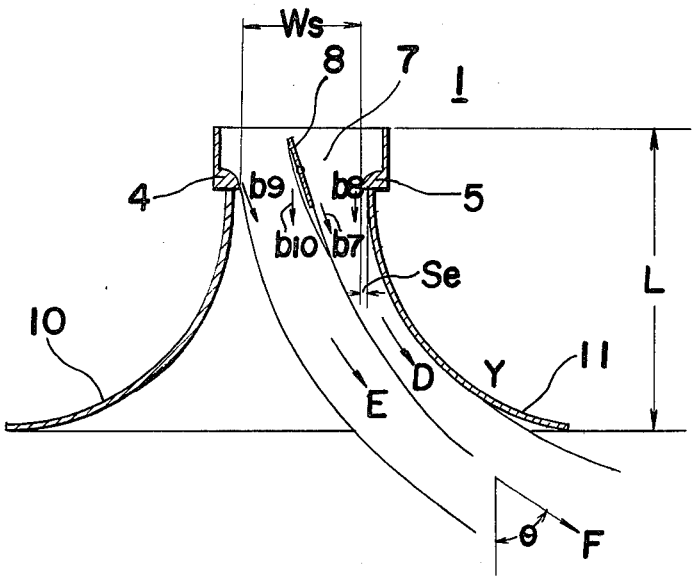

If the deflecting blade 8 is further pivoted counterclockwise to the first extreme position as shown in FIG. 4, the flow component $b_8$ at the exit side of the nozzle defining ridge 5 is forced to flow in a direction inwardly of the nozzle center plane due to the contraction, but the deflecting force of the flow component $b_7$ along the deflecting blade 8 continues to act in a region downstream of the nozzle 7. Furthermore, the tendency of the flow component $b_7$ to flow in a direction rightwards as viewed in FIG. 4 is increased as compared with that shown in FIG. 3. Accordingly, the current D, the direction of flow of which has primarily been determined by the position of the deflecting blade 8 is further deflected rightwards as compared with that in FIG. 3 towards the guide wall 11. Because of this, the Coanda effect predomintes more than that in FIG. 3 and the detachment point is shifted to a position, as shown by Y, downstream of the detachment point X shown in FIG. 3.

On the other hand, the current E flowing through the channel between the nozzle defining ridge 4 and the deflecting blade 8 is forced to flow in a direction corresponding the direction of flow of the current D by the action of the tendency of the flow component $b_9$ tending to flow in a direction rightwards and the tendency of the current D to attract the current E and, subsequently joins the current D to provide the fluid stream flowing outwards from the fluid diverting assembly 1 in the direction as shown by arrow F in FIG. 4.

The wall adherence of the fluid stream issued from the nozzle is generally enhanced when the nozzle width Ws is small for a given radius of rounding of the nozzle defining ridges 4 and 5. Accordingly, if the deflecting blade 8 protrudes downstream of the nozzle 7, the width of one of the currents divided by the blade 8 is smaller than that in the case where the blade is located completely upstream of the nozzle so that the wall adherence can be enhanced.

It is to be noted that the shape of the fluid diverting assembly 1 and the shape and position of the deflecting blade 8 need not be symmetrical with respect to the nozzle center plane in order that the advantages and effects of the present invention be assured. Moreover, although the guide walls 10 and 11 have been described and shown as curved, they are not limited thereto, but may be straight or of any other shape.

According to a series of experiments conducted by the inventors, it has been found that the fluid diverting assembly having a length L, as measured between the plane of the supply port 6 and the plane of the exit opening of the assembly 1, of a value equal to or smaller than three times the nozzle width Ws will make possible an angle of deflection $\theta$ up to 60° relative to the nozzle center plane.

It is to be noted that during the continued rotation of the blade 8 from the position shown in FIG. 2 to the position shown in FIG. 4, the detachment point, which is shown by X and Y in FIGS. 3 and 4, respectively, correspondingly shifts. Therefore, the direction in which the fluid stream flowing outwards in a direction tangential to the detachment point can continuously be controlled. It is also to be noted that since the guide walls are shaped to protrude in a direction downstream of the nozzle in such a manner as to separate from the fluid stream, the continuous deflection control can be carried out from a condition in which the fluid stream flows straight in a direction parallel to the nozzle center plane to a condition in which the wall adherence takes place.

Figure 5:
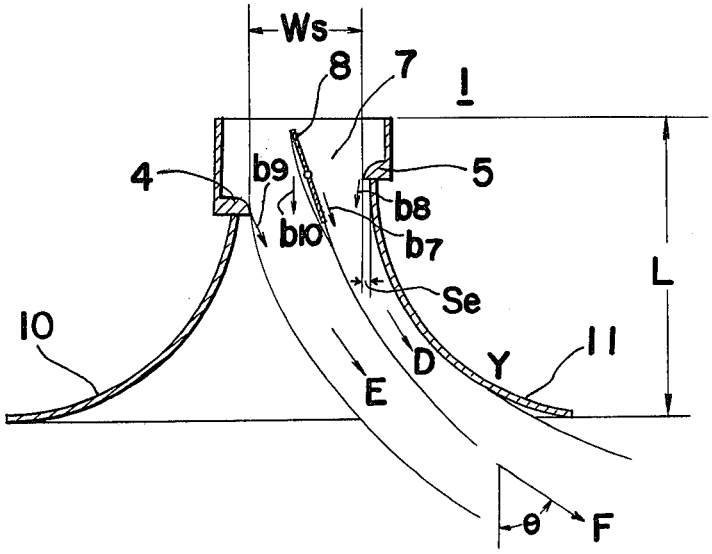
FIG. 5 is a view similar to FIG. 4, showing another embodiment of the present invention.

It is further to be noted that the elongated walls 2 and 3 need not have equal lengths such as shown, but may have different lengths, such as shown in FIG. 5, so that the plane of the nozzle 7 is inclined with one of the nozzle defining ridges 4 and 5 being positioned downstream of the other of the nozzle defining ridges 4 and 5.

Figure 6:
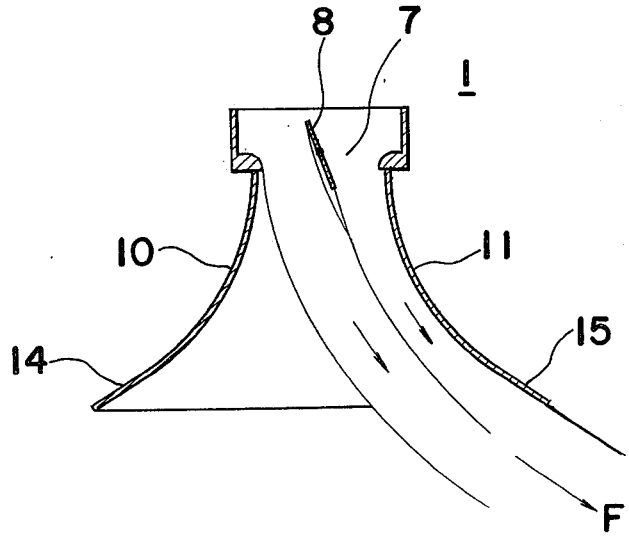
FIG. 6 is a view similar to FIG. 2, showing a further embodiment of the present invention.

In the foregoing embodiments shown in FIGS. 1 to 4 and FIG. 5, respectively, each of the guide walls 10 and 11 is shown as arcuately curved. However, they may be straight or partially straight. For example, in the embodiment shown in FIG. 6, respective portions 14 and 15 of the guide walls 10 and 11 adjacent the exit opening of the fluid diverting assembly 1 are straight while the remaining portions of the guide walls 10 and 11 are arcuately curved. The fluid diverting assembly having the construction shown in FIG. 6 is advantageous in that the fluid stream, when the deflecting blade 8 is held at either of the first or second extreme positions, for example, the first extreme position as shown, will flow along the entire length of guide wall 11 after having been deflected at the maximum possible angle of deflection and, therefore, can overcome the back pressure.

In any one of the foregoing embodiments hereinbefore described, the fluid diverting assembly will operate in a similar manner as hereinbefore described when the deflecting blade 8 is rotated to the second extreme position in which case the fluid stream will be deflected in a direction leftwards as viewed in any one of FIGS. 2 to 6.

As best shown in FIG. 4, each upstream side edge of the guide walls 10 and 11 adjacent the nozzle 7 and secured to the corresponding nozzle defining ridge 4 or 5 is displaced a distance Se outwardly from the tip of such corresponding nozzle defining ridge 4 or 5 to define a setback area. The stream of fluid emerging through the nozzle 7 can flow straight along the nozzle center plane, when and so long as the deflecting blade 8 is held in the position as shown in FIG. 2, without adhering to either one of the guide walls 10 and 11. In other words, the employment of the setback area Se is advantageous in that, when and so long as the deflecting blade 8 is held in the position as shown in FIG. 2, the fluid stream flows straight outwards from the fluid diverting assembly 1 in a direction parallel to the nozzle center plane without adhering to either one of the guide walls 10 and 11.

However, the employment of the setback area Se involves a difficulty in that the guide walls 10 and 11 can not readily be formed integrally with the corresponding nozzle defining ridges 4 and 5. This disadvantage can substantially be eliminated by employing an arrangement as shown in FIG. 7 wherein no setback area is employed.

Figure 7:
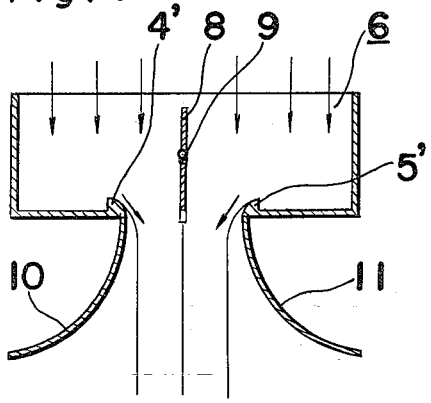
FIG. 7 is a view similar to FIG. 2, wherein the radius of curvature of each of the nozzle defining ridges is smaller than the radius of rounding of each of guide walls.

Referring now to FIG. 7, reference numerals 4' and 5' represent nozzle defining ridges each having a relatively small radius of curvature.

The operation of the fluid diverting assembly 1 having the construction shown in FIG. 7 is such that a fluid supplied to the supply port 6 flows through the nozzle 7, defined between the nozzle defining ridges 4' and 5', to the outside of the fluid diverting assembly 1 by way of the fluid exit passage defined between the guide walls 10 and 11. However, since the radius of curvature of each of the nozzle defining ridges 4' and 5' has a relatively small value as hereinbefore described, the fluid stream passing through the nozzle 7 is contracted in a manner as shown in FIG. 7. This in turn results in an increase in the clearance between the fluid stream and the guide walls 10 and 11 and, therefore, any possibility of the fluid stream to adhering to either one of the guide walls 10 and 11 is advantageously be eliminated.

However, since the contraction of flow is utilized in the arrangement shown in FIG. 7, the fluid stream flowing in the fluid diverting assembly 1 having the construction shown in FIG. 7 tends to meet with increased flow resistance. Where the flow resistance is a prime problem to be solved, the employment of an arrangement such as shown in FIG. 8 is advantageous.

Figure 8:
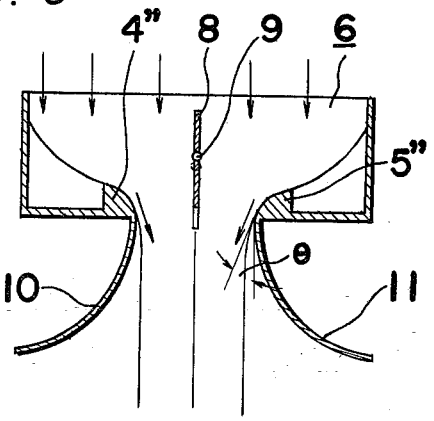
FIG. 8 is a view similar to FIG. 2, wherein there is an angle between each of the nozzle defining ridges and the adjacent guide wall.
Figure 9:
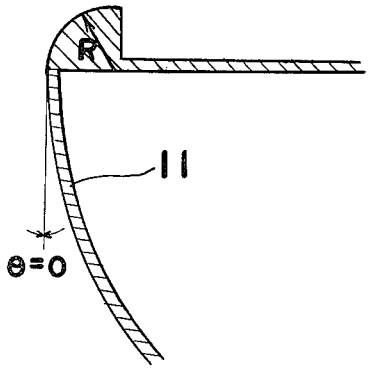
FIG. 9 is a cross sectional view, on an enlarged scale, of a portion of the fluid diverting assembly, similar in construction to that shown in FIG. 7, showing the case where the angle between each of the nozzle defining ridges and the adjacent guide wall is zero.
Figure 10:
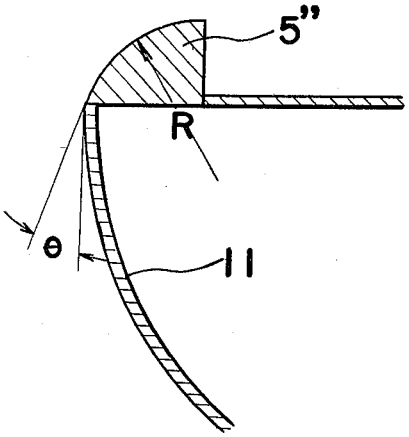
FIG. 10 is a view similar to FIG. 9, showing a portion of the fluid diverting assembly shown in FIG. 8.

Referring to FIG. 8, reference numerals 4'' and 5'' represent respective nozzle defining ridges which have a tangent to the curved surface thereof at an angle $\theta$ to the surfaces of the associated guide walls 10 and 11. Where the angle $\theta$ is equal to zero as shown in FIG. 9, the flow resistance will be increased whereas if the angle $\theta$ is suitably selected such as shown in FIG. 10, the flow resistance can advantageously be minimized.

The operation of the fluid diverting assembly having the construction shown in FIG. 8 will now be described.

The fluid supplied to the supply port 6 flows through the nozzle 7, defined between the nozzle defining ridges 4'' and 5'', to the outside of the fluid diverting assembly 1 by way of the fluid exit passage defined between the guide walls 10 and 11. During the flow of the fluid stream through the fluid diverting assembly 1 having the construction shown in FIG. 8, no contraction of the fluid stream takes place at either one of the nozzle defining ridges 4'' and 5''. However, since the tangent to the surfaces of the nozzle defining ridges 4'' and 5'' is at an angle $\theta$ relative to the surfaces of the associated guide walls 10 and 11, the fluid stream entering the fluid exit passage tends to separate from each of the guide walls 10 and 11, rather than adhering to the adjacent guide wall 10 or 11. Accordingly, by suitably selecting the angle $\theta$, the possibility of occurrence of the contraction can be avoided with the flow resistance consequently being decreased, so that a relatively accurate flow direction control can be achieved.

It is to be noted that, in all of the foregoing embodiments, the deflection capability of the fluid diverting assembly can be improved by suitably designing the deflecting blade 8 in a manner as shown in FIGS. 11 to 17.

Figure 11:
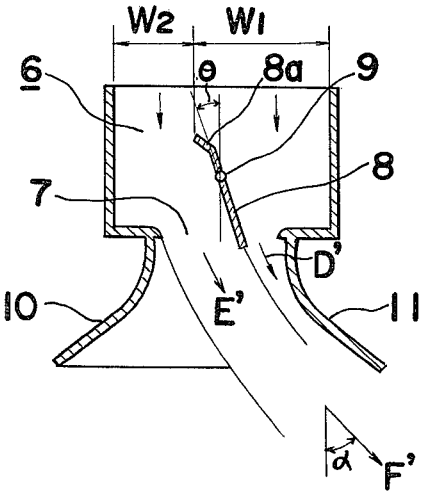
FIGS. 11 to 13 are views similar to FIG. 2, showing a still further embodiment of the present invention with the deflecting blade held in different operative positions.
Figure 12:
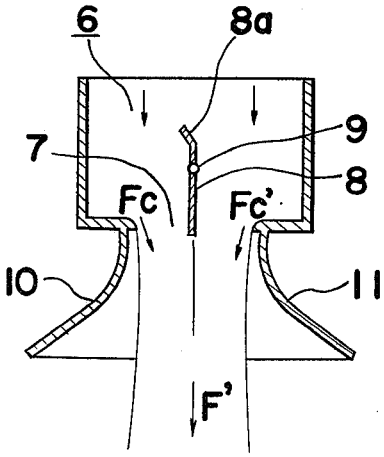
Figure 13:
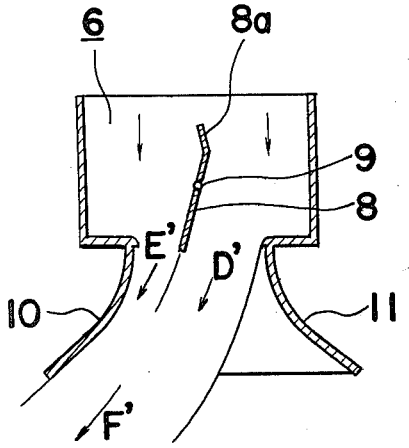

Referring first to FIGS. 11 to 13, one edge portion of the deflecting blade 8 which is located upstream of the axis of rotation thereof with respect to the direction of flow of the fluid from the supply port 6 towards the nozzle 7 is bent as shown at **8*a* to such an extent that the edges of the bent portion 8*a* of the deflecting blade 8** are always located at the upstream side during the rotation of the deflecting blade between the first and second extreme positions.

The operation of the fluid diverting assembly 1 having the construction shown in FIGS. 11 to 13 will now be described.

Assuming that the deflecting blade 8 is held at the first extreme position as shown in FIG. 11, the fluid supplied to the supply port 6 is divided into two currents at the upstream edge of the bent portion **8*a* of the blade 8. The current flowing on the right-hand side of the deflecting blade 8 subsequently adheres to the guide wall 11 as is the case with the current D shown in FIG. 4 whereas the current flowing on the left-hand side of the deflectng blade 8 is subsequently attracted towards the current flowing along the guide wall 11**.

Assuming that the angle $\theta$ shown in FIG. 11 is fixed, the ratio of the distance $W_1$ between the wall 3 and the upstream edge of the bent portion **8*a* relative to the distance $W_2$ between the wall 2 and the upstream edge of the bent portion 8*a*, that is, $W_1/W_2$, is greater than that in the case where the deflectng blade 8 has no bent portion. This means that the velocity of the current D' flowing on the right-hand side of the blade 8** becomes higher than that in the case where the blade has no bent portion. Because of the increase of the velocity of the current D' relative to the velocity of the current E', the current E' will readily join the current D' whereby the angle of the deflection $\alpha$ is increased.

If the deflecting blade 8 is subsequently rotated from the position shown in FIG. 11 to the position intermediate between the first and second extreme positions, as shown in FIG. 12, the fluid supplied to the supply port 6 is, even in this case, divided into two currents, one flowing on the right-hand side of the blade 8 and the other flowing on the left-hand side of the blade 8, by the upstream edge of the bent portion 8*a* of the deflecting blade 8. In this conditon although there is a difference in flow rate between the current flowing on the right-hand side of the blade and the current flowing on the left-hand side of the blade 8, the edge portion of the blade 8 opposite to the bent portion 8*a* is oriented in a direction parallel to the nozzle center plane and, therefore, in a manner similar to the case of FIG. 2, flow components Fc and Fc′ are directed in respective directions away from the associated guide walls 10 and 11. Therefore, the flow components Fc and Fc′ subsequently flow outwards through the nozzle 7 and then through the fluid exit passage without adhering to either one of the guide walls 10 and 11, the consequence of which is that the fluid stream flows outwardly of the fluid diverting assembly 1 in a direction as indicated by arrow F′ in FIG. 12.

Where the deflecting blade is rotated from the position shown in FIG. 11 to the second extreme position as shown in FIG. 13, due to the particular shape of the deflecting blade 8 according to the present invention, the current flowing on the right-hand side of the deflecting blade 8 becomes a flow component flowing along the deflecting blade 8 without being separated from the blade 8 at the upstream side. Accordingly, subsequent joining of the currents can readily be facilitated and any disturbance, which may hamper the ready joining of the currents due to the reduction in velocity of the current flowing on the left-hand side of the blade 8 which has resulted from the employment of the bent portion 8*a*, is advantageously compensated for. Therefore, even when the deflecting blade 8 is rotated to the second extreme position as shown in FIG. 13, not only is a reduction in the angle of deflection avoided, but also the flow resistance is reduced to an extent corresponding to the extent to which no separation of the current from the blade 8 has taken place.

In view of the above, with the flid diverting assembly of the construction shown in FIGS. 11 to 13, the minimum possible angle of rotation of the deflecting blade 8 is sufficient to give a relatively wide angle of deflection.

It is to be noted that the bent portion 8*a* in the foregoing embodiment shown in FIGS. 11 to 13 has been shown as being straight and flat. However, the bent portion 8*a* may be curved and the fluid diverting assembly will operate in a substantially similar manner as described with reference to FIGS. 11 to 13. In particular, where the bent portion 8*a* is curved, further reduction in flow resistance is possible. However, a deflecting blade 8 having a curved or bent portion 8*a* will require a complicated manufacturing procedure as compared with that required in the manufacture of the deflecting blade 8 having the shape shown in any one of FIGS. 1 to 8.

Figure 14:
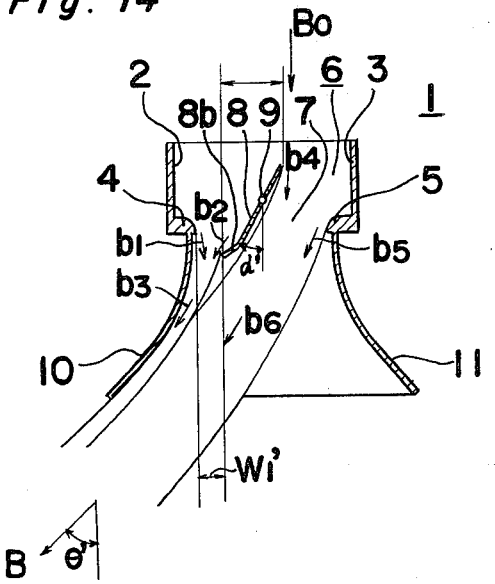
FIGS. 14 to 16 are views similar to FIGS. 11 to 13, showing a still further embodiment of the present invention with the deflecting blade held in different operative positions.
Figure 15:
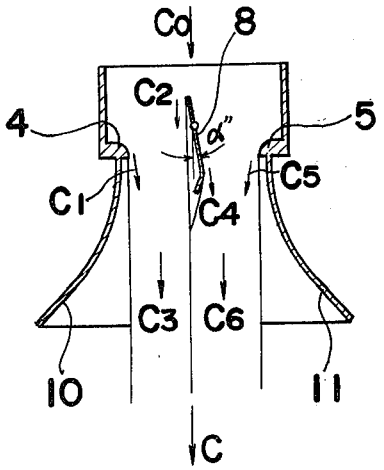
Figure 16:
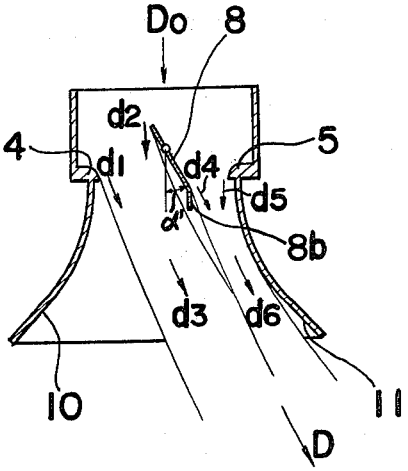

FIGS. 14 to 16 illustrate an example wherein the edge portion of the deflecting blade 8 which is located at the downstream edge is bent as shown by 8*b*. The manner of flow of the fluid stream depending upon the position of the deflecting blade 8 is illustrated in FIGS. 14 to 16.

It is, however, to be noted that the downstream edge of the bent portion 8*b* of the deflecting blade 8 is so designed as to always to be located at the downstream side during the rotation of the deflecting blade 8 between the first and second extreme positions.

The operation of the fluid diverting assembly having the construction shown in FIGS. 14 to 16 will now be described.

In FIG. 14, the deflecting blade 8 is shown as being rotated to the second extreme position. In this condition, the fluid current flowing between the deflecting blade 8 and the nozzle defining ridge 4 has a flow component flowing adjacent the nozzle defining ridge 4 which is forced to flow in a direction as shown by $b_1$ in FIG. 14. On the other hand, the current flowing along the deflecting blade 8 is, at the downstream end, forced by the bent portion 8*b* to flow in the direction shown by $b_2$, being deflected leftwards at an angle greater than the angle $\alpha'$ of rotation of the deflecting blade 8. Because the leftward flow tendency of the current $b_2$ icreases, the wall adherence effect of the current $b_3$ relative to the adjacent guide wall 10 is correspondingly increased.

In addition, because of the employment of the bent portion 8*b* of the deflecting blade 8, the blow-off width $W_1'$ defined between the nozzle defining ridge 4 and the downstream edge of the bent portion 8*b* of the deflecting blade 8 is reduced to such an extent that the wall adherence of the current $b_3$ relative to the guide wall 10 is enhanced.

On the other hand, in the fluid flowing between the nozzle defining ridge 5 and the deflecting blade 8, a flow component $b_4$ flowing past the upstream edge of the blade 8 is separated from the upstream edge of the deflecting blade 8 and is subsequently forced to flow in a straight direction. However, a flow components $b_5$ of the fluid current flowing between the nozzle defining ridge 5 and the deflecting blade 8, which flows adjacent the nozzle defining ridge 5, is inwardly oriented and, therefore, as a whole, the current $b_6$ is attracted toward the current $b_3$ to produce a fluid current $b_6$. Therefore, the fluid stream flowing through the fluid exit passage between the guide walls 10 and 11 is forced to flow in the direction as indicated by the arrow B in FIG. 14.

From the above, it will readily be seen that the deflection angle $\theta'$ is greater with the deflecting blade having the construction shown in FIGS. 14 to 16 than with that having the construction shown in FIGS. 1 to 8, for a given angle of rotation of the deflecting blade 8.

In FIG. 15, the deflecting blade 8 is shown as pivoted slightly leftwards. In this condition, in the fluid current flowing between the nozzle defining ridge 4 and the deflecting blade 8, the flow component flowing adjacent the nozzle defining ridge 4 is forced to flow inwardly in a direction as shown by the arrow $C_1$ in FIG. 15 while a flow component flowing past the upstream edge of the deflecting blade 8 tends to flow in a straight direction as shown by the arrow $C_2$. Accordingly, the flow components respectively flowing in the directions $C_1$ and $C_2$ subsequently become a fluid current flowing in a straight direction as shown by the arrow $C_3$.

On the other hand, in the fluid current flowing between the deflecting blade 8 and the nozzle defining ridge 5, a flow component flowing along the deflecting blade 8 as shown by $C_4$ is deflected slightly rightwards while a flow component flowing adjacent the nozzle defining ridge 5 as shown by $C_5$ flows in a direction slightly leftwards, so that the current will subsequently flow in a straight direction as shown by $C_6$ without adhering to either one of the guide walls 10 and 11.

The fluid currents $C_3$ and $C_6$ when they join each other flow in a straight direction as shown by C in FIG. 15.

In FIG. 16, the deflecting blade 8 is shown as pivoted slightly rightwards. In this conditon, in the fluid current flowing between the nozzle defining ridge 5 and the deflecting blade 8, a flow component $d_5$ flowing adjacent the nozzle defining ridge 5 is directed slightly leftwards. However, since a flow component $d_4$ flowing along the deflecting blade 8 has a strong tendency to be deflected rightwards, the fluid current as a whole flows in a rightward direction and subsequently adheres to the guide wall 11 as shown by $d_6$.

On the other hand, in the fluid current flowing between the nozzle defining ridge 4 and the deflecting blade 8, a flow component flowing adjacent the upstream edge of the deflecting blade is separated therefrom, thereby flowing in a straight direction as shown by $d_2$ while a flow component flowing adjacent the nozzle defining ridge 4 is directed slightly rightwards. Under the influence of the flow of the flow current $d_1$, the flow component $d_2$ is forced to flow in a rightward direction and is finally attracted to the flow component $d_6$ to provide the fluid current $d_3$.

In the final state, the fluid stream emerging from the fluid diverting assembly 1 flows in the direction as indicated by D in FIG. 16. However, since the width of the bent portion **8*b* of the deflecting blade 8 is suitably selected, the fluid current $d_3$ will not be disturbed when the fluid currents $d_3$ is attracted to the fluid current $d_6$. This means that the fluid stream can be deflected rightwards, as viewed in FIG. 16, in a similar manner to the case where the deflecting blade 8 has no bent portion 8*b***.

It is to be noted that the bent portion **8*b* in the foregoing embodiment shown in FIGS. 14 to 16 has been shown as being straight and flat. However, the bent portion 8*b* may be curved and the fluid diverting assembly will operate in a substantially similar manner as described with reference to FIGS. 14 to 16**.

Figure 17:
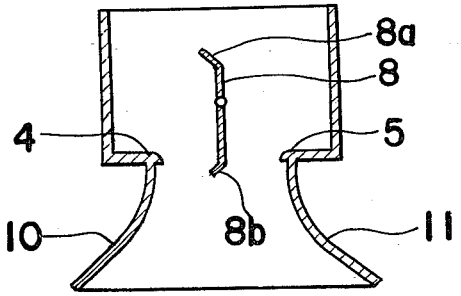
FIG. 17 is a view similar to FIG. 1, showing a still further embodiment of the present invention.

In the embodiment shown in FIG. 17, the opposite edge portions of the deflecting blade 8 are bent, which may be considered to be a combination of the deflecting blade shown in FIGS. 11 to 13 and that shown in FIGS. 14 to 16.

With the deflecting blade having the construction shown in FIG. 17, the rightward deflection is enhanced by the presence of the bent portion **8*a* on the one hand and the leftward deflection is enhanced by the presence of the bent portion 8*b***. Accordingly, the deflecting blade as a whole brings about an increased angle of deflection.

It is to be noted that each of the bent portions **8*a* and 8*b* has been shown as being straight and flat. However, it may be curved and still a similar effect to that produced by the fluid diverting assembly having the construction shown in FIG. 17 can be attained. The presence of the bent portions 8*a* and 8*b* on the deflecting blade 8 brings about an additional advantage that the strength of the deflecting blade 8** with respect to the bending moment as a whole is improved.

Hereinafter, an automatic deflection of the fluid stream by the use of the fluid diverting assembly according to the present invention will be described.

Figure 18:
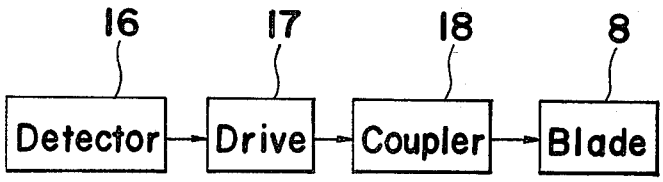
FIG. 18 is a schematic diagram showing a circuit for rotating the deflecting blade.

In FIG. 18, reference numeral 16 designates a detector for detecting a change in a physical parameter in response to which deflection of the fluid stream is to be automatically performed. Reference numeral 17 designates a drive unit for driving the deflecting blade 8 upon receipt of a signal from the detector. Reference numeral 18 designates a coupling unit for transmitting a drive from the drive unit 17 to the deflecting blade 8.

Figure 19:
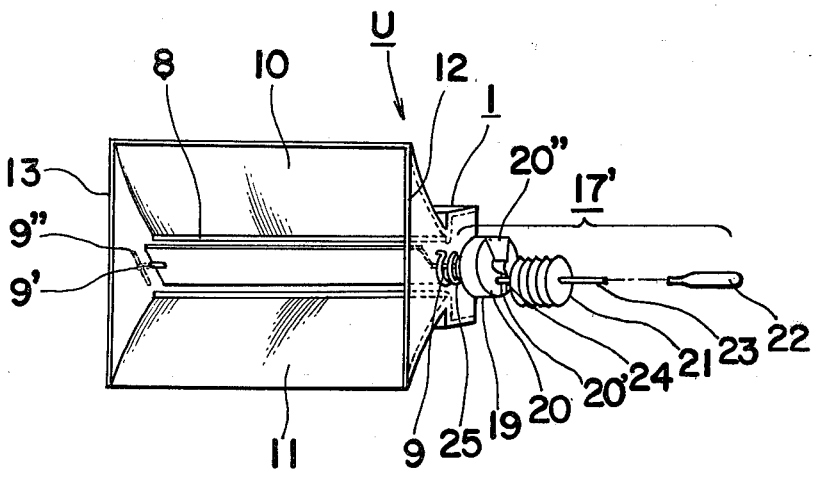
FIG. 19 is a schematic perspective view of the fluid diverting assembly according to a still further preferred embodiment of the present invention.

Referring now to FIG. 19, the fluid diverting assembly 1 shown therein can have a construction according to any one of the foregoing embodiments respectively shown in FIGS. 1 to 4, FIG. 5, FIGS. 6 and 7, FIG. 8, FIGS. 11 to 13 and FIGS. 14 to 16. It is however to be noted that the opposite ends of the shaft 9 having the deflecting blade 8 rigidly mounted thereon are shown as rotatably extending through the end plates 12 and 13 and being situated outside the fluid diverting assembly. The end 9' of the shaft 9 adjacent the end plate 13 has a stop element 9'' rigidly mounted thereon for preventing the shaft 9 and, hence, the deflecting blade 8 from being axially moved, while the other end of the shaft 9 adjacent the end plate has a cam member 19 rigidly mounted thereon.

The cam member 19 has a shape having an inclined ramp 20 extending substantialy helically in a direction axially of the shaft 9 and having its opposite ends provided with engagement walls 20' and 20''. It is to be noted that the length of the inclined ramp 20 as measured between the engagement walls 20' and 20'' corresponds to the angle through which the deflecting blade 8 can be rotated about the longitudinal axis of the shaft 9.

Reference numeral 21 designates a bellows having its interior coupled to a sensor probe 22 through a connecting tube 23 and filled with a thermally expansible material which may be either liquid or gas. The bellows 21 has one end, the end remote from the connecting tube 23, from which a pusher rod 24 extends outwardly and has the end in contact with the inclined ramp 20 on the cam member 19. The sensor probe 22 is adapted to be located at any suitable place where a change in the physical parameter in response to which the automatic fluid deflection is to be performed can be detected.

Figure 20:
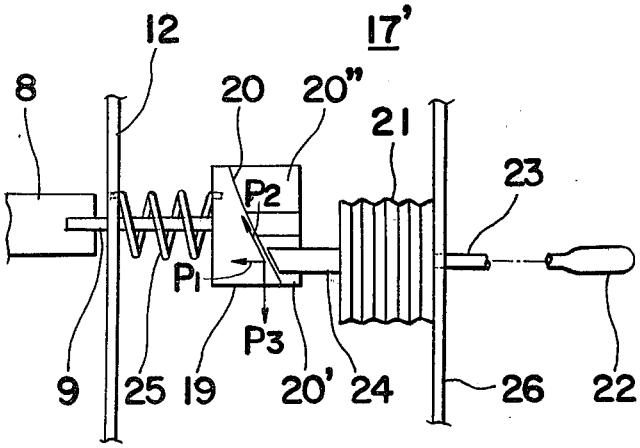
FIG. 20 is a schematic longidutinal view, on an enlarged scale, of a drive mechanism employed in the fluid diverting assembly shown in FIG. 19.

FIG. 20 illustrates the details of the drive unit shown in FIG. 19. As best shown in FIG. 20, a torsion spring 25 is positioned around the shaft 9 and extends between the end plate 12 and the cam member 19 and has its opposite ends rigidly connected to the end plate 12 and the cam member 19, respectively. This torsion spring 20 serves to bias the cam member 19 in a direction towards the bellows 21 with the inclined ramp 20 in turn acting on the pusher rod 24 under a predetermined pressure. This torsion spring 25 also serves to rotate the cam member 19 in one direction back towards its original position when and after the cam member 19 has been rotated in the opposite direction against the torsion spring 25 in a manner as will be described later. It is to be noted that the bellows 21 is supported by a stationary support plate 26 which can be fixed in position in any known manner.

Figure 21:
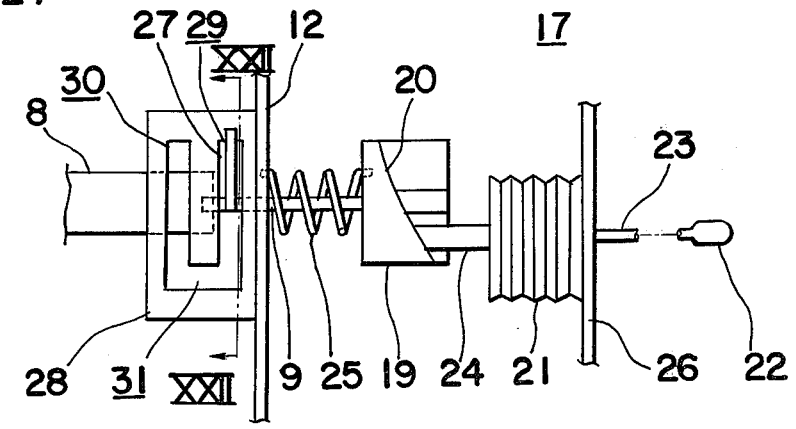
FIG. 21 is a view similar to FIG. 20, showing a modified form of drive mechanism.
Figure 22:
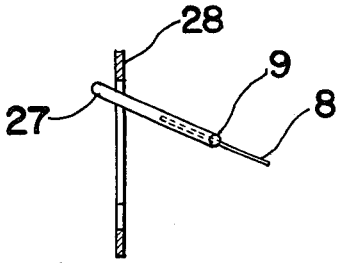
FIG. 22 is a cross sectional view taken along the line XXII—XXII in FIG. 21.

The arrangement shown in FIG. 20 may be modified in the manner as shown in FIGS. 21 and 22. Referring to FIGS. 21 and 22, reference numeral 27 represents a lever having one end rigidly connected to the shaft 9 and the other end loosely extending through a substantially U-shaped guide groove defined in a lever retainer plate 28 which is rigidly secured to the end plate 12. The guide groove in the retainer plate 28 is constituted by a pair of spaced groove sections 29 and 30, which extend in parallel relation to each other in a plane substantially perpendicular to the longitudinal axis of the shaft 9, and a transit groove section 31 extending in a direction substantially parallel to the longitudinal axis of the shaft 9 and having its opposite ends communicating with the corresponding ends of the respective groove sections 29 and 30.

Figure 23:
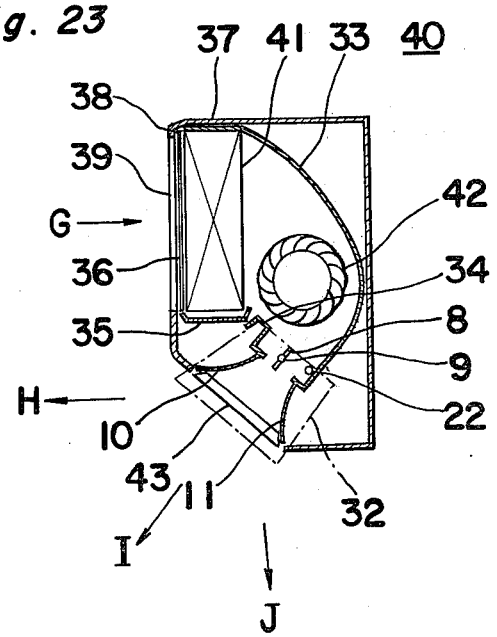
FIG. 23 is a schematic side sectional view of an indoor unit of an air-conditioner having the fluid diverting assembly incorporated therein.

FIG. 23 illustrates an indoor unit of a known heat pump type air-conditioner of which utilizes the fluid diverting unit, generally identified by U in FIG. 19, having the construction shown in FIGS. 18 to 20.

Referring now to FIG. 23, the air conditioner indoor unit, generally identified by 40, is a type adapted to be secured to a wall, enclosing a room to be air-conditioned, at a position ajacent the ceiling of the room. This indoor unit 40 includes a heat exchanger 41, a blower 42, a fluid exit structure 32, a guide duct 33 extending between the heat exchanger 41 and the fluid diverting assembly, and a stabilizer 34, as is well known to those skilled in the art.

Reference numeral 35 designates a drain tray for receiving and draining condensed liquid falling from the heat exchanger 41, reference numeral 36 designates a filter, reference numeral 37 designates a casing, reference numeral 38 designates a front grill structure, and reference numeral 39 designates a suction opening in the front grill structure 38.

Figure 24:
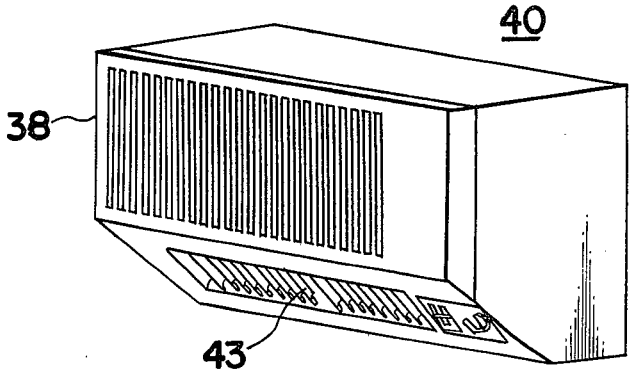
FIG. 24 is a schematic perspective view of the air-conditioner indoor unit shown in FIG. 23, showing the outer appearance thereof.

In the fluid exit structure 32, the fluid diverting assembly is shown as having a plurality of deflecting blades 43 for deflecting the fluid stream, flowing through the fluid exit passage between the guide walls 10 and 11, in a direction leftwards and righwards as viewed in a direction towards the indoor unit 40. This air-conditioner indoor unit 40 is shown in perspective view in FIG. 24.

The operation will now be described.

Referring first to FIG. 18, the signal generated from the detector 16 is applied to the drive unit 17 to operate the latter to provide a drive force which is transmitted through the coupling unit 18 to the deflecting blade 8 to rotate the latter to achieve an automatic fluid deflection.

Depending upon the type of the parameter, the change of which is to be detected by the detector 16, various types of detectors can be used. By way of example, where the parameter is temperature, the detector 16 may employ a bimetallic material, a thermally expansible liquid, a thermally expansible gas, a thermally expansible solid, a thermistor, or a posistor. Where the parameter is humidity, the detector 16 may employ a humidity sensor. On the other hand, where the parameter is air velocity, the detector 16 may employ a pressure responsive sensor.

The drive unit may include a bimetallic material, a bellows, a solenoid unit or an electric motor. However, the use of bimetallic material is advantageous in that it can also serve as a detector for detecting a change in the parameter.

Assuming that the deflecting blade 8 is positioned as shown in FIG. 19, in which condition the fluid stream emerging through the nozzle flows upward adhering to and along the guide wall 10 and an increase in temperature takes place at a location to which the fluid stream is desired to be directed, the temperature sensed by the sensor probe 22 increases and the thermally expansible material contained therein consequently expands. Therefore, the bellows 21 expands.

As best shown in FIG. 20, as the bellows 21 expands in the manner described above, the pusher rod 24 projects outwards in a direction away from the stationary support plate 26, thereby causing the cam member 19 to rotate in one direction without biasing the cam member 19 in a direction axially of the shaft 9. This is possible because of the contact of the free end of the pusher rod 24 with the inclined helical ramp 20. More specifically, when the bellows 21 expands in the manner described above, a biasing force $P_1$ acts on the cam member 19 through the pusher rod 24 slidably contacting the inclined ramp 20. However, since the force of friction between the pusher rod 24 and the inclined ramp 20 is smaller than the force $P_2$ of a vector component of the biasing force $P_1$ which acts in a direction parallel to the inclined ramp 20 and also since the force exerted by the torsion spring 25 to rotate the cam member 19 in a direction back towards the original position is smaller than the force $P_3$ of a vector component of the force $P_1$ which acts in a direction circumferentially of the cam member 19, the cam member 19 will rotate against the force of the torsion spring 25. Therefore, it is clear that the angle of rotation of the cam member 19 and, hence, the deflecting blade 8, corresponds to the displacement of the pusher rod 24 resulting from the expansion of the bellows 21.

However, when the temperature at the location to which the fluid stream is desired to be directed subsequently decreases, the temperature of the sensor probe 22 correspondingly decreases and the thermally expansible material undergoes contraction. Therefore, the bellows 21 contracts and the pusher rod 24 is displaced in a direction rightwards as viewed in FIG. 20. As the pusher rod 24 moves in the rightward direction in the manner described above, the cam member 19 and, hence, the deflecting blade 8, is rotated in a direction back towards the original position by the action of the biasing force accummulated in the torsion spring 25.

From the foregoing, it will readily be seen that, as the deflecting blade 8 is reciprocally rotated in response changes in the temperature sensed by the sensor probe 22, the fluid stream emerging from the fluid diverting assembly and subsequently from the fluid exit structure 32 as shown in FIG. 23 will be deflected to a direction between a horizontal direction and a vertical direction.

To the extent that the fluid diverting assembly according to the present invention is used as a component of the fluid exit structure 32 of the air-conditioner indoor unit, since the magnitude of change in termperature is small, the amount of displacement of the pusher rod 24 resulting from the expansion of the bellows 21 is correspondingly small. However, since in the fluid diverting assembly according to the present invention a slight rotation of the deflecting blade 8 is sufficient to effect a relatively wide angle of deflection of the fluid stream, the fluid diverting assembly according to the present invention can effectively and advantageously be used as a component of the air-conditioner.

It is to be noted that the engagement walls 20' and 20'' at the respective ends of the inclined ramp 20 are so positioned that the rate of flow of the fluid stream emerging from the fluid diverting assembly will not fall below a predetermined value end if the deflecting blade 8 is rotated to such an extent that the pusher rod 24 relatively sliding along the inclined ramp 20 abuts one or the other of the engagement walls 20' and 20''.

In FIG. 21, when the lever 27 is positioned in the groove section 29 in the manner as shown therein, the drive unit for the deflecting blade 8 operates in a manner similar to the operation of the drive unit shown in FIG. 20. However, at this time, the lever 27 undergoes an angular movement within the groove section 29 due to the rotation of the shaft 9, thereby providing a visual indication showing the consecutive positions of the deflecting blade 8 being rotated.

However, when the lever 27 is manually pulled towards the transit guide section 31 and then moved to the groove section 30 by way of the transit guide section 31, the shaft 9 and, therefore, the deflecting blade 8, is axially moved leftwards, as viewd in FIG. 21, a distance substantially corresponding to the pitch between the parallel groove sections 29 and 30. Since the pitch between the parallel groove sections 29 and 30 is selected so to be greater than the maximum axial displacement of the pusher rod 24 resulting from the expansion of the bellows 21, the inclined ramp 20 is disengaged from the free end of the pusher rod 24 and the axial movement of the pusher rod 24 will no longer be transmitted to the cam member 19. In other words, when the lever 27 is shifted from the groove section 29 to the groove section 30 in the manner described above, a manual adjustment of the position of the deflecting blade 8, i.e., a manual adjustment of the direction in which the fluid stream is desired to be directed, is possible.

It is to be noted that, as the lever 27 is moved along the groove section 29 towards the transit groove section 31, the torsion spring 25 is twisted to accummulate a return biasing force. In addition, when the lever 27 engaged in the transmit groove section 31 is moved from one end of the groove section 31 adjacent the groove section 29 towards the opposite end thereof adjacent the groove section 30 accompanied by the corresponding axial displacement of the shaft 9, the torsion spring 25 is axially compressed to accumulate an axial biasing force. However, since the axial biasing force accummulated in the torsion spring 25 is greater than the return biasing force accummulated in the same torsion spring 25, the lever 27, when engaged in the groove section 30, is pressed under pressure against a tongue portion positioned between the parallel groove sections 29 and 30. Therefore, as long as the lever 27 is engaged in the groove section 30, the lever 27 will be held at any position between the opposite ends of the groove section 30 due to the frictional contact between the lever 27 and the tongue portion between the parallel groove sections 29 and 30. Therefore, by suitably positioning the lever 27 within the groove section 30 at any desired intermediate position between the opposite ends of the groove section 30, the direction in which the fluid stream emerges from the fluid exit structure 32 can be selected as desired and at an operator's will.

If the lever 27 engaged in the groove section 30 is manually shifted to the groove section 29 in a manner opposite to the shift of the lever from the groove section 29 into the groove section 30, the cam member 19 will be axially moved in a direction away from the end wall 12 until the tip of the pusher rod 24 contacts the inclined ramp 20, and the cam member will subsequently be rotated by the expansion of the bellows 21 in the manner described hereinbefore to effect automatic deflection of the fluid stream.

As hereinbefore described, since the slight expansion of the bellows 21 is sufficient to effect the automatic fluid deflection, the length of the transit groove section 31 which must be sufficient to allow the disengagement of the inclined ramp 20 from the tip of the pusher rod 24 may have a relatively small value. Furthermore, during the manual adjustment of the direction of flow of the fluid stream which can be effected by moving the lever 27 within the groove section 30, a slight movement of the lever 27 will result in a relatively wide angle of deflection.

In FIG. 23, the air-conditioner indoor unit 40 is shown as having incorporated in the fluid exit structure 32 the fluid diverting unit U having the construction shown in FIG. 19. In the example shown in FIG. 23, the sensor probe 22 is positioned so as to detect a change in temperature of the fluid stream flowing in a supply chamber defined by the walls 2 and 3 and the end plates 12 and 13 (FIG. 1). Therefore, it is clear that, during the automatic fluid deflection, the deflecting blade 8 will be rotated in the manner as hereinbefore described in rsponse to a change in temperature of the fluid stream being discharged through the fluid exit structure 32 towards the room to be air-conditioned.

However, it is to be noted that the sensor probe 22 may be positioned at any suitable location, for example, at a position upstream of the heat exchanger 41, within the room to be air-conditioned, or at an outdoor location, depending upon the control desired.

During a heating operation of the air-conditioner, air sucked from the room to be air-conditioned into the indoor unit 40 in the direction indicated by the arrow G through the suction opening 39 and past the filter 36 flows through the heat-exchanger 41 wherein the sucked air is heated by heat-exchange in a known manner. The heated air subsequently flows towards the blower 42 by which it is forced to flow towards the room to be air-conditioned by way of the fluid diverting assembly in the fluid exit structure 32.

It has often been experienced that the air sucked into the indoor through the suction opening 39 is discharged back to the room through the fluid exit structure 32 without being heated during its passage through the heat-exchanger 41 during the heating operation of the air-conditioner. This often occurs particuarly at the start of operation of the air-conditioner, during a heat-off condition of the air-conditioner, or during a de-icing operation of the air-conditioner. In such case, occupants within the room to be air-conditioned will not feel comfortable and, therefore, it is desirable to direct the air emerging from the fluid exit structure 32 in a direction upwardly of the occupants and parallel to the ceiling. For this purpose, the position of the engagement wall in the cam member 19 is so selected that, when the bellows 21 is contracted to a maximum extent while the sensor probe 22 continues to detect a relatively low temperture, the engagement of the pusher rod 24 with the engagement wall on the cam member 19 is such that the deflecting blade 8 will be held at one of the opposite extreme positions which is required for the fluid stream issued through the nozzle 7 to be directed to flow along the guide wall 10 and in a direction as indicated by the arrow H in FIG. 23. By so doing, it will readily be understood that, when and so long as the temperature of the fluid stream emerging from the exit structure 32 into the room to be air-conditioned has such a low value that the occupants will feel uncomfortable when the air is blown on them, the fluid stream will be directed to flow in the direction as shown by the arrow H without being directed onto the occupants within the room. When the temperature of the fluid stream emerging from the exit structure 32 into the room to be air-conditioned subsequently increases, the deflecting blade 8 will be rotated in the manner as hereinbefore described to deflect the fluid stream. By way of example, when the temperature of the fluid stream supplied into the room has a relatively high value, the deflecting blade 8 will be rotated to the other of the opposite extreme positions with the fluid stream directed in a direction indicated by the arrow J.

Where the fluid diverting unit U according to the embodiment shown in FIG. 21 is employed in the air-conditioner, not only can the manual adjustment of the direction of flow of the fluid stream be effected, but also a cold draft which often occurs during the heating mode of operation of the air-conditioner can advantageously be avoided.

It is to be noted that care should be taken in selecting the size of the engagement wall 20' on the cam member 19 so as to avoid any possible separation of the tip of the pusher rod 24 from the cam member 19 during the cooling mode of operation of the air-conditioner.

In the embodiment shown in FIGS. 25 to 28, the fluid diverting assembly according to the present invention positioned in the fluid exit structure 32 (FIG. 23) of the air-conditioner indoor unit is operable in three modes one at a time, which are respectively referred to as the Auto Mode, the Manual Mode and the Forced Swing Mode.

In the auto mode operation, the fluid stream emerging from the fluid diverting assembly and, hence, the fluid exit structure 32 of the air-conditioner indoor unit 40 (FIG. 23), is deflected in response to a change in temperature of the fluid stream then emerging outwardly from the fluid diverting assembly. In this condition, the deflecting blade 8 is rotated by a drive mechanism which is energized to rotate the deflecting blade 8 only when the temperature of the fluid stream then emerging outwardly from the fluid diverting assembly changes.

In the manual mode operation, the fluid stream emerging from the fluid diverting assembly can be deflected in any desired direction at the operator's will. In this condition, the deflecting blade 8 is disengaged from the drive mechanism and can be rotated manually to adjust the direction in which the fluid stream then emerging from the fluid diverting assembly is to be directed.

In the forced swing mode operation, the fluid stream emerging from the fluid diverting assembly undergoes a swinging motion, irrespective of any change in temperature of the fluid stream, so as to direct the fluid stream over a relatively wide area. In this condition, the deflecting blade 8 is rotated reciprocatingly in the opposite directions by the drive mechanism which is energized irrespective of a change in temperature of the fluid stream.

Figure 25:
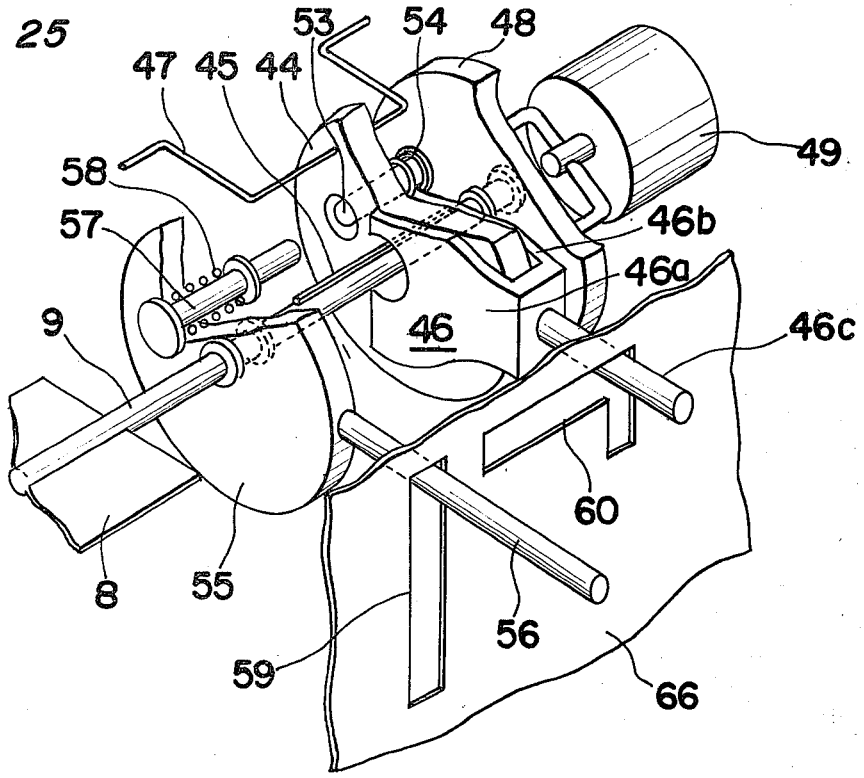
FIG. 25 is a schematic perspective view, on an enlarged scale, of a further modified form of the drive mechanism for rotating the deflecting blade.
Figure 26:
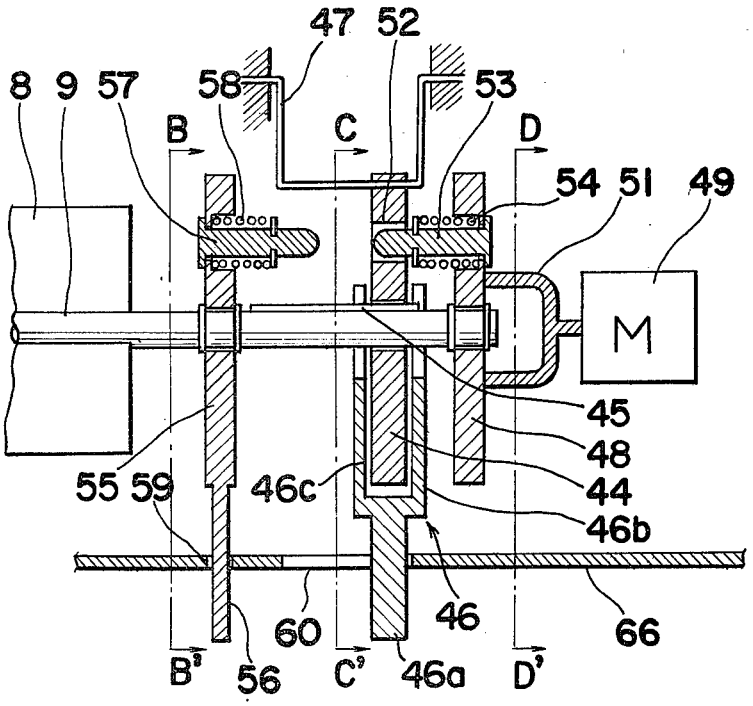
FIG. 26 is a longitudinal sectional view of the drive mechanism shown in FIG. 25.

Referring particularly to FIGS. 25 and 26, the end portion of the shaft 9 rotatably extending outwardly through the end plate 12 (in the manner as shown in FIGS. 19 to 21) carries a drive disc 48, a transmission disc 44 and a manipulatable disc 55, all of which are positioned between the end plate 12 and an electric motor 49.

The transmission disc 44 is mounted on the end portion of the shaft 9 for movement in a direction axially of the shaft 9 and also for rotation together with the shaft 9. For this purpose, a portion of the shaft has an axially extending key shown at 45, the length of said key 45 being slightly greater than the distance of movement of the transmission disc 44 in the axial direction of the shaft 9. The movement of the transmission disc in the direction axially of the shaft 9 between first and second operative positions is effected manually by means of a forked lever assembly 46 having a construction which will now be described.

The forked lever assembly 46 has an arm **46*a* having one end a pair of parallel spaced fingers 46*b* and 46*c* spaced a distance slightly greater than the thickness of the transmission disc 44. The other end of the arm 46*a* remote from the fingers 46*b* and 46*c* is accessible to the operator and, for this purpose, extends loosely through a substantially L-shaped slot 60, defined in a control panel 66, and terminates outside the air-conditioner indoor unit, while the transmission disc 44 mounted on the end portion of the shaft 9 is accommodated within the space between the fingers 46*b* and 46*c***.

From the foregoing, it will readily be seen that, when the arm **46*a* is manually moved within the horizontally extending section of the L-shaped guide slot 60 in the panel 66 which extends in parallel relation to the longitudinal axis of the shaft 9, the transmission disc 44 is moved between the first and second operative positions. However, movement of the arm 46*a* within the vertically extending section of the L-shaped guide slot 60, which extends in a direction perpendicular to the longitudinal axis of the shaft, does not result in any motion of the transmission disc 44, but will operate an Auto-Swing selector switch which will be described later with reference to FIG. 27**.

Reference numeral 47 designates a return biasing wire spring having its opposite ends rigidly connected to any suitable fixed portion, as best shown in FIG. 26, a substantially intermediate portion of which loosely extends through the outer peripheral portion of the transmission disc 44. This return biasing spring 47 is so positioned and so designed that, irrespective of the position of the transmission disc 44 on the end portion of the shaft 9 and also irrespective of the position to which the transmission disc 44 is rotated together with the shaft 9, the transmission disc 44 will be held at or returned to a predetermined angular position when and so long as the motor 49 is not operated. The predetermined angular position at which the transmission disc 44 is held or to which it is returned by the return biasing spring 47 is such that the deflecting blade 8 is held at an upward blow position in which the fluid stream emerging from the fluid diverting assembly will flow in a direction substantially parallel to the ceiling of the room to be air-conditioned such as shown by the arrow H in FIG. 23.

The drive disc 48 is mounted on the end extremity of the shaft 9 for rotation independently of the rotation of the shaft 9 and is coupled to the electric motor 49 so that rotation of the motor 49 is transmitted to said drive disc 48. The drive disc 48 carries a connecting rod 53 which is supported for movement between projected and retracted positions in a direction perpendicular to the drive disc 48 and is normally biased to the projected position by a biasing spring 54. This connecting rod 53 is engageable in an engagement hole 52, defined in the transmission disc 44, so that when the transmission disc 44 is moved to one of the first and second operative positions, for example, to the first operative position as shown, the rotation of the motor 49 is transmitted from the drive disc 48 to the shaft 9 through the transmission disc 44 and the connecting rod 53 engaged in the hole 52 in the transmission disc 44. It is to be noted that even if the hole 52 in the transmission disc 44 fails to register with the connecting rod 53 when the transmission disc 44 is moved to the first operative position, the connecting rod 53 will be moved to the retracted position against the force of the spring 54 until subsequent rotation of the motor 49 brings the connecting rod 53, held in the retracted position, into alignment or registration with the hole 52.

The manipulatable disc 55 is similar in construction to the drive disc 48 and has a connecting rod 57 and a return biasing spring 58, all of them being operable in a similar manner to the connecting rod 53 and the return biasing spring 54. However, it is to be noted that, since the drive disc 48 and the manipulatable disc 55 are positioned on opposite sides of the transmission disc 44, the connecting rods 53 and 57, when in their respective projected positions, project outwardly into the space which is defined between the drive disc 48 and the manipulatable disc 55.

The manipulatable disc is also mounted on the end portion of the shaft 9 for rotation independently of the rotation of the shaft 9 and has a lever 56 protruding outwardly from the outer periphery of the manipulatable disc 55 and terminating outside the air-conditioner indoor unit, a substantially intermediate portion of said lever 56 loosely extending through a vertically extending guide slot 59 which is defined in the control panel 66 at a position next to the L-shaped guide slot 60. The manipulatable disc 55 is rotated when the lever 56 is moved within the guide slot 59, and the rotation of the manipulatable disc 55 thus effected is transmitted to the shaft 9 through the transmission disc 44 only when the latter is moved to the second operative position in which the hole 52 receives therein the connecting rod 57.

Figure 27:
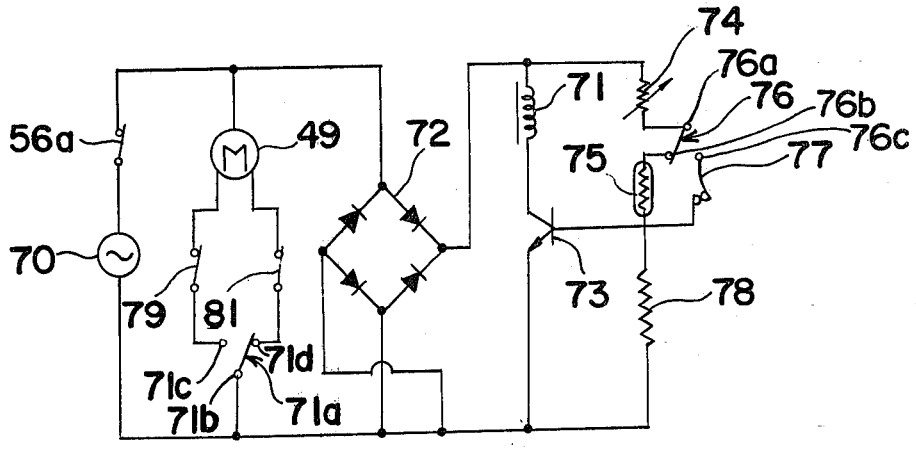
FIG. 27 is a diagram showing an electric circuit for the drive mechanism shown in FIG. 25.

Referring now to FIG. 27 which is an electric circuit diagram of the circuit for operating the motor 49 which in the present embodiment is a reversible A.C. motor. In the electric circuit diagram shown in FIG. 27, reference numeral 70 designates a source of A.C. power. Reference numeral 56*a* designates a power supply switch adapted to be opened when the arm 46*a* is moved to one end of the horizontally extending section of the L-shaped guide slot 60 remote from the vertically extending section of the guide slot 60, that is, when the transmission disc 44 is moved to the second operative position to bring the fluid diverting assembly into the manual mode operation, and closed when the arm 46 is moved to the other end of the horizontally extending section of the L-shaped guide slot 60 and within the vertically extending section of the guide slot 60, that is, when the transmission disc 44 is moved to the first operative position and so long as the arm 46*a* is moved within the vertically extending section of the guide slot 60.

Reference numeral 72 designates a rectifier for converting the alternating current from the power source 70 into a direct current required to operate the reversible A.C. motor 49. Reference numerals 71, 73, 74 and 75 respectively designates a relay coil, a transistor, a variable resistor and a thermistor. The variable resistor 74 is used to determine the temperature setting of the thermistor 75 which detects the temperature of the fluid stream emerging from the fluid diverting assembly and, for this purpose, is installed in a similar manner to the sensor probe 22 shown in FIG. 23.

Reference numeral 76 designates the Auto-Swing selector switch having a movable contact 76*a* and a pair of fixed contacts 76*b* and 76*c*, said movable contact 76*a* being engaged with the fixed contact 76*b* during the auto mode operation and with the fixed contact 76*c* during the forced swing mode operation as will be described later. It is to be noted that this selector switch 76 is operatively associated with the arm 46*a* that when the arm 46*a* is so held at the auto mode position, as shown in FIG. 25, which corresponds to the junction between the horizontally and vertically extending sections of the guide slot 60, the movable contact 76*a* is engaged with the fixed contact 76*b* as shown in FIG. 27 while, when the arm 46*a* is held at the swing position which corresponds to the other end of the vertically extending section of the guide slot 60 remote from the junction of the vertically extending section to the horizontally extending section, the movable contact 76*a* is engaged with the fixed contact 76*c*.

Reference numeral 77 designates a bimetallic switch adapted to open when an electric current flows therethrough to such an extent that a bimetallic element used therein is heated to a predetermined temperature. Reference numeral 71*a* designates a relay switch operatively associated with the relay coil 71 in such a manner that when the electric current flows through the relay coil 71, a movable contact 71*b* is engaged with a fixed contact 71*c*, and when no current flows through the relay coil 71, the movable contact 71*b* is biased into contact with the opposite fixed contact 71*d*. It is to be noted that, during the engagement of the movable contact 71*b* to the fixed contact 71*c*, the motor 49 is rotated in one direction, for example, counterclockwise, to rotate the deflecting blade 8 towards the upward blow position in which the fluid stream emerging from the fluid diverting assembly will flow in a direction substantially parallel to the ceiling of the room to be air-conditioned such as shown by the arrow H in FIG. 23, while during the engagement of the movable contact 71*b* with the fixed contact 71*d*, the motor 49 is rotated in the opposite direction, that is, clockwise, to rotate the deflecting blade 8 towards a downward blow position in which the fluid stream emerging from the fluid diverting assembly will flow in a direction substantially downwardly of the air-conditioner indoor unit as shown by the arrow J in FIG. 23.

Figure 28:
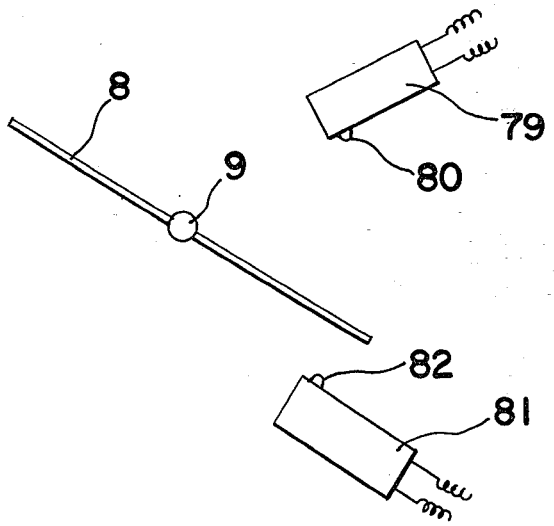
FIG. 28 is a schematic diagram showing an arrangement of switches, employed in the electric circuit of FIG. 27, in relation to the deflecting blade.

Reference numeral 49 designates a microswitch positioned so as to be opened when the deflecting blade 8 is rotated to the downward blow position, one side edge portion of said blade 8 depressing an actuator 80 of the switch 79 as shown in FIG. 28, while reference numeral 81 designates a microswitch positioned so as to be opened when the deflecting blade 8 is rotated to the upward blow position, said one side edge portion of said blade 8 depressing an actuator 82 of the switch 81 as shown in FIG. 28.

The operation of the embodiment shown in FIGS. 25 to 28 in the different modes will now be described node-by-node.

Auto Mode Operation

The arm 46*a* is positioned in the manner as shown in FIG. 25 irrespective of the position of the lever 56. In this condition, not only is the switch 56*a* closed, but also the movable contact 76*a* of the selector switch 76 is engaged with the fixed contact 76*b*. Simultaneously therewith, the transmission disc 44 is coupled to the drive disc 48 with the connecting rod 53 being immediately or subsequently engaged in the hole 52 in the transmission disc 44 in the manner as hereinbefore described, whereby the shaft 9 and, therefore, the deflecting blade 8, is rotated.

The engagement of the movable contact 76*a* with the fixed contact 76*b* which has taken place in response to the movement of the arm 46*a* to the auto mode position allows the electric current to flow through the thermistor 75. When the thermistor 75 detects that the temperature of the fluid stream emerging from the fluid diverting assembly exceeds the temperature setting of the thermistor 75, the resistance of the thermistor 75 decreases and a relatively large amount of current flows therethrough. Then, a trigger voltage is applied to the base of the transistor 73 to switch the latter on to complete the electric circuit to the relay coil 71. Therefore, the current flows through the relay coil 71 to energize the latter and the movable contact 71*b* of the relay switch 71*a* is consequently engaged with the fixed contact 71*c*. The consequence is that the motor 49 is rotated in the counterclockwise direction to rotate the deflecting blade 8. When the actuator 80 of the microswitch 79 is depressed by the deflecting blade 8 to open the switch 79, the rotation of the motor 49 is interrupted and, therefore, the deflecting blade 8 is fixed at the downward blow position.

However, when the thermistor 75 detects that the temperature of the fluid stream is below the temperature setting of the thermistor 75, the resistance of the thermistor 75 increases and, therefore, no trigger voltage is applied to the base of the transistor 73. Therefore, the transistor 73 is held in a non-conductive state and no current flows through the relay coil 71 and, consequently, the movable contact 71*b* of the relay switch 71*a* is engaged with the fixed contact 71*d*.

In this condition, the motor 49 is rotated in the clockwise direction to rotate the deflecting blade 8 from the downward blow position towards the upward blow position. When the actuator 82 of the microswitch 81 is depressed by the deflecting blade 8 to open the switch 81, the rotation of the motor 49 is interrupted and, therefore, the deflecting blade 8 is fixed at the upward blow position.

As hereinbefore described, it is clear that during the auto mode operation, the deflecting blade 8 is held at the downward blow position when the temperature of the fluid stream emerging from the fluid diverting assembly is higher than a predetermined temperature and at the upward blow position when the temperature of the same is lower than the predetermined temperature.

Forced Swing Mode Operation

The arm 46*a* is, if it is positioned at either the manual mode position or the auto mode position as shown in FIG. 25, moved to the swing mode position. In this condition, not only is the switch 56*a* closed, but also the movable contact 76*a* of the selector switch 76 is engaged with the fixed contact 76*c* in the manner as hereinbefore described. It is to be noted that since the transmission disc 44 is held in the first operative position as shown in FIGS. 25 and 26 as long as the arm 46*a* is located within the vertically extending section of the L-shaped guide slot 60, when the closure of the switch 56*a* causes the motor 49 to rotate, the rotation of the motor 49 is transmitted to the shaft 9 through the transmission disc 44 in a manner similar to that during the auto mode operation.

The engagement of the movable contact 76*a* with the fixed contact 76*c* causes the current to flow through the bimetallic switch 77. It is to be noted that by adjusting the variable resistor 74, the amount of current flowing through the bimetallic switch 77 can be varied. In any event, during the flow of the current through the bimetallic switch 77, the transistor 73 is switched on and the current flows through the relay coil 71 to energize the latter. Therefore, the movable contact 71*b* of the relay switch 71*a* is engaged with the fixed contact 71*c* and, therefore, the motor 49 is rotated in the counterclockwise direction to rotate the deflecting blade 8 towards the downward blow position.

When the deflecting blade 8 being rotated towards the downward blow position depresses the actuator 80 of the microswitch 79 upon its arrival at the downward blow position, the rotation of the motor 49 is interrupted and, therefore, the deflecting blade is held at the downward blow position.

However, since the bimetallic element of the switch 77 deforms when heated by the current flowing therethrough, the bimetallic switch 77 is subsequently opened upon deformation of the bimetallic element. Upon opening of the bimetallic switch 77, the current flowing through the transistor 73 is interrupted and, therefore, the relay coil is deenergized. Accordingly, the movable contact 71*b* of the relay switch 71*a* is engaged with the fixed contact 71*d*, the consequence of which is that the motor 40 is rotated in the clockwise direction to rotate the deflecting blade 8 from the downward blow position towards the upward blow position. The rotation of the motor 49 is subsequently interrupted when the deflecting blade 8 arriving at the upward blow position depresses the actuator 82 of the microswitch 81.

If the bimetallic element of the bimetallic switch 77 is subsequently cooled to such an extent that the switch 77 itself is closed, the relay coil 71 is again energized and, therefore, the motor 49 is rotated in the counterclockwise direction to rotate the deflecting blade 8 from the upward blow position back towards the downward blow position.

The foregoing cycle of operation is repeated as long as the arm 46*a* is held in the swing mode position and effects a swinging motion of the fluid stream emerging from the fluid diverting assembly as the deflecting blade 8 is reciprocated between the upward and downward blow positions. It is to be noted that the duration of one cycle of operation, that is, one reciprocation of the deflecting blade 8 from the upward blow position to the downward blow position and from the downward blow position back towards the upward blow position, can be varied by suitably adjusting the variable resistor 74 since the adjustment of the variable resistor 74 results in adjustment of the amount of the electric current supplied through the bimetallic switch 77.

Manual Mode Operation

The arm 46*a* is moved to the manual mode position corresponding to the end of the guide slot 60 opposite to the end which defines the swing mode position. As the arm 46*a* is moved towards the manual mode position, the transmission disc 44 is also moved towards the second operative position.

With the transmission disc 44 held in the second operative position, the manipulatable disc 55 is readily coupled with the transmission disc 44 by the engagement of the connecting rod 57 in the hole 52 so long as the lever 56 is held at a position corresponding to the upward blow position of the deflecting blade 8. This is possible because of the return biasing wire spring 46 acting on the transmission disc 44 to return the deflecting blade to the upward blow position immediately after the transmission disc 44 is disengaged from the drive disc 48 with the connecting rod 54 moves out of the hole 52.

If the lever 56 is positioned at a position other than the position corresponding to the upward blow position of the deflecting blade 8 when the transmission disc 44 is moved to the second operative position, the connecting rod 57 is moved to the retracted position against the force of the spring 58 as the rod 57 is contacted by the transmission disc 44. In this case, by moving the lever 56 to the position corresponding to the upward blow position of the deflecting blade 8, the manipulatable disc 55 is coupled to the transmission disc 44 by engagement of the connecting rod 57 in the hole 52.

After the manipulatible disc 55 has been coupled to the transmission disc 44 in the manner described above, the direction in which the fluid stream emerging from the fluid diverting assembly can be varied by moving the lever 56 within the guide slot 59.

From the foregoing, it is clear that since the deflecting blade is so positioned as to extend upstream and downstream of the nozzle according to the present invention, not only can a relatively wide angle of deflection of the fluid stream be achieved as compared with a similar fluid diverting assembly wherein no deflecting blade is used, but also the angle of deflection of the fluid stream can be continuously controlled. Moreover, since the fluid diverting assembly according to the present invention can have a size with a length L equal to or smaller than three times the nozzle width Ws, it can effectively and advantageously be used without substantially increasing the size of the apparatus in which it is incorporated.

In view of the above, the present invention provides a fluid diverting assembly which has many industrial applications. In particular, since the fluid diverting assembly according to the present invention is provided with means for avoiding the wall adherence of the fluid stream emerging from the nozzle when the deflecting blade is held at a position required for the fluid stream to flow in a direction parallel to the nozzle center plane, the following advantages are achieved.

(1) By giving the radius of curvature of each of the nozzle defining ridges a value such that the fluid stream flowing through the nozzle will contract to such an extent that no wall adherence of the fluid stream will take place, accurate and effective control of the direction of deflection of the fluid stream can be achieved and any possible wall adherence of the fluid stream which might otherwise take place when the deflecting blade is held at the position required for the fluid stream to flow in a direction parallel to the nozzle center plane is avoided. (2)

By suitably giving to the angle between a tangent to each of the nozzle defining ridges and the adjacent guide wall a relatively large value, it is possible to control the direction in which the fluid stream is desired to flow without causing any increased flow resistance.

With the fluid diverting assembly according to the present invention wherein the capabliltiy of the deflecting blade to cause fluid deflection and the fluid deflection achieved by the Coanda effect occurring at the downstream side of the nozzleare effectively utilized, a relatively wide angle of deflection of the fluid stream can readily and effectively be achieved without causing any reduction in flow rate and yet the length of the fluid diverting assembly can be reduced.

Moreover, since a slight angular displacement of the deflecting blade is sufficient to effect the deflection of the fluid stream, a slight displacement occurring in the drive unit in response to the detection of the temperature is sufficient to effect a relatively wide angle of deflection of the fluid stream.

By the employment of the coupling unit, it is possible to change the mode of operation of the fluid diverting assembly between the automatic deflection adjustment, mode and the manual deflection adjustment mode.

When the fluid diverting assembly according to the present invention is used in an air-conditioner, any possible cold draft which may occur at the start of operation of the air-conditioner, thermo-off time or during the deicing of the air-conditioner, during the heating, can advantageously be avoided, thereby making the room more comfortable to live in.

In particular, the fluid diverting assembly shown in FIGS. 25 and 28 has the following additional advantages.

(3) Since the fluid diverting assembly utilizes the Coanda effect, a slight angular displacement of the deflecting blade is sufficient to result in a relatively wide angle of deflection of the fluid stream and, therefore, the apparatus can readily be provided with an automatic deflection adjustment capability, a manual deflection adjustment capablilty and the capablility of automated swing of the fluid stream.

(4) The forced swing mode operation of the fluid diverting assembly can advantageously be utilized where it is desired to stir the air within the room to be air-conditioned to substantially eliminate uneven distribution of temperature.

(5) Deflection of the fluid stream by the use of the deflecting blade does not adversely affect the performance of the air-conditioner.

Although the present invention has fully been described in connection with the preferred embodiments thereof with reference to the accompanying drawings, it is to be noted that various changes and modifications will be apparent to those skilled in the art. Such changes and modifications are to be understood as being included within the true scope of the present invention unless they depart therefrom.

What is claimed is:

1. A fluid deflecting assembly of the type for confining the flow of fluid therethrough to flow in only two dimensions, said assembly comprising: a nozzle means for issuing a main stream of fluid as the fluid passes therethrough, said nozzle means having a nozzle defining structure with a relatively small thickness in the direction of flow of fluid therethrough as compared with the width thereof in the direction at right angles to the direction of flow of the fluid therethrough; an outlet means through which the fluid emerges from said nozzle, said outlet means connected to said nozzle and being constituted by a pair of spaced opposed guide walls having a shape diverging from each in a direction downstream with respect to the direction of flow of a stream of fluid issuing from said nozzle and opening outwardly in a direction away from said nozzle and at least the upstream portions thereof being curved; there being a substantially abrupt dicontinuity between the curvature of said nozzle defining structure at the exit end thereof and the upstream ends of said guide walls which constitutes a detachment region; and a deflecting blade mounted in said assembly with the upstream and downstream edges respectively upstream and downstream of said nozzle and for rotation between a position perpendicular to the plane of the nozzle opening and first and second extreme positions on opposite sides of and at an angle to said perpendicular position and at which said blade is spaced from the nozzle defining structure for dividing the fluid medium flowing through said assembly into two fluid currents at all positions of said blade and, when the blade is in a position other than said perpendicular position, said blade diverts the current on the side of the blade toward which the downstream end of the blade has been deflected, said guide walls being positioned sufficiently close to the path of the diverted current for causing the diverted current to adhere to the curved guide wall to which it has been diverted said discontinuity and said blade cooperating to direct the current on the other side of said blade into said diverted current and then to facilitate adjoinment of both said currents to thereby control the direction of flow of the fluid stream emerging from said outlet means.

2. A fluid diverting assembly as claimed in claim 1, wherein each of the guide walls is outwardly curved along the full length thereof.

3. A fluid diverting assembly as claimed in claim 1, wherein each of the guide walls is constituted by a curved portion and a straight portion contiguous to said curved portion and positioned downstream of the curved portion with respect to the direction of flow of the fluid stream.

4. A fluid diverting assembly as claimed in claim 1, wherein said detachment region is constituted by a step defined between the exit side of the nozzle means and the upstream end of the corresponding guide wall.

5. A fluid diverting assembly as claimed in claim 1, wherein said detachment region has a shape in which a tangent to the exit side of the inlet means extends at a predetermined angle to the tangent to the upstream end of the corresponding guide wall.

6. A fluid diverting assembly as claimed in claim 1, wherein said deflecting blade is constituted by a thin flat plate.

7. A fluid diverting assembly as claimed in claim 1, wherein said bent portion of the deflecting blade is straight.

8. An air-conditioner comprising a blower and a heat-exchanger, and an improved fluid exit structure from said blower, said fluid exit structure comprising a nozzle means for issuing a main stream of fluid as the fluid passes therethrough, said nozzle means having a nozzle defining structure with a relatively small thickness in the direction of flow of fluid therethrough as compared with the width thereof in the direction at right angles to the direction of flow of the fluid therethrough; an outlet means through which the fluid emerges from said nozzle, said outlet means connected to said nozzle and being constituted by a pair of spaced opposed guide walls having a shape diverging from each other in a direction downstream with respect to the direction of flow of a stream of fluid issuing from said nozzle and opening outwardly in a direction away from said nozzle and at least the upstream portions thereof being curved; and a deflecting blade mounted in said assembly with at least the downstream end in said nozzle for rotation between a position perpendicular to the plane of the nozzle opening and first and second extreme positions on opposite sides of and at an angle to said perpendicular position at which said blade is spaced from the nozzle defining structure for dividing the fluid medium flowing through said assembly into two fluid currents at all positions of said blade and, when the blade is in a position other than said perpendicular position, diverting the current on the side of the blade toward which the downstream end of the blade has been deflected, said guide walls being positioned sufficiently close to the path of the diverted current for causing the diverted current to adhere to the curved guide wall to which it has been diverted and to draw the current on the other side of said blade into said diverted current to thereby control the direction of flow of the fluid stream emerging from said outlet means, means connected to said blade for supplying force for reciprocally swinging said blade between the first and second extreme positions, and means for coupling the swinging means to the deflecting blade.

9. An air-conditioner as claimed in claim 8, wherein said coupling means comprises means for disengaging the swinging means from the deflecting blade.

10. An air-conditioner comprising a blower, a heat-exchanger and an improved fluid exit structure, said fluid exit structure comprising a nozzle means for issuing a main stream of fluid as the fluid passes therethrough, said nozzle means having a nozzle defining structure with a relatively small thickness in the direction of flow of fluid therethrough as compared with the width thereof in the direction at right angles to the direction of flow of the fluid therethrough; an outlet means through which the fluid emerges from said nozzle, said outlet means connected to said nozzle and being constituted by a pair of spaced opposed guide walls having the shape diverging from each other in a direction downstream with respect to the direction of flow of a stream of fluid issuing from said nozzle and opening outwardly in a direction away from said nozzle and at least the upstream portions thereof being curved; and a deflecting blade mounted in said assembly with at least the downstream end in said nozzle for rotation between a position perpendicular to the plane of the nozzle opening and first and second extreme positions on opposite sides of and at an angle to said perpendicular position at which said blade is spaced from the nozzle defining structure for dividing the fluid medium flowing through said assembly into two fluid currents at all positions of said blade and, when the blade is in a position other than said perpendicular position, diverting the current on the side of the blade toward which the downstream end of the blade has been deflected, said guide walls being positioned sufficiently close to the path of the diverted current for causing the diverted current to adhere to the curved guide wall to which it has been diverted and to draw the current on the other side of said blade into said diverted current to thereby control the direction of flow of the fluid stream emerging from said outlet means, means for detecting a change in the magnitude of a parameter in response to the direction of flow of the air stream is desired to be changed, a drive source connected to said detecting means and responsive to a signal generated from said detecting means for providing a force for rotating the deflecting blade between said first and second extreme positions, and means coupling said drive source to said deflecting blade.

11. An air-conditioner as claimed in claim 10, wherein said coupling means comprises means for disengaging the drive source from the deflecting blade.

12. An air-conditioner comprising, a blower, a heat-exchanger, and an improved fluid exit structure, said fluid exit structure comprising a nozzle means for issuing a main stream of fluid as the fluid passes therethrough, said nozzle means having a nozzle defining structure with a relatively small thickness in the direction of flow of fluid therethrough as compared with the width thereof in the direction at right angles to the direction of flow of the fluid therethrough; an outlet means through which the fluid emerges from said nozzle, said outlet means connected to said nozzle and being constituted by a pair of spaced opposed guide walls having a shape diverging from each other in a direction downstream with respect to the direction of flow of a stream of fluid issuing from said nozzle and opening outwardly in a direction away from said nozzle and at least the upstream portions thereof being curved; and a deflecting blade mounted in said assembly with at least the downstream end in said nozzle for rotation between a position perpendicular to the plane of the nozzle opening and first and second extreme positions on opposite sides of and at an angle to said perpendicular position at which said blade is spaced from the nozzle defining structure for dividing the fluid medium flowing through said assembly into two fluid currents at all positions of said blade and, when the blade is in a position other than said perpendicular position, diverting the current on the side of the blade toward which the downstream end of the blade has been deflected, said guide walls being positioned sufficiently close to the path of the diverted current for causing the diverted current to adhere to the curved guide wall to which it has been diverted and to draw the current on the other side of said blade into said diverted current to thereby control the direction of flow of the fluid stream emerging from said outlet means, means for providing a force for driving the deflecting blade between the first and second extreme positions in response to a change in magnitude of a parameter in response to which the direction of flow of the air stream is desired to be changed, means detachably connected to said driving means and said deflecting blade for swinging the deflecting blade reciprocately between the first and second extreme positions, manual adjusting means for manually adjusting the position of the deflecting blade between the first and second extreme positions, and means for connecting said driving means to said swinging means and for disconnecting said manual adjusting means from said deflecting blade and for disconnecting said driving means from said swinging means and connecting said manual adjusting means to said deflecting blade.

13. A fluid deflecting assembly comprising: a nozzle means for issuing a main stream of fluid as the fluid passes therethrough, said nozzle means having a nozzle defining structure with a relatively small thickness in the direction of flow of fluid therethrough as compared with the width thereof in the direction at right angles to the direction of flow of the fluid therethrough; an outlet means through which the fluid emerges from said nozzle, said outlet means connected to said nozzle and being constituted by a pair of spaced opposed guide walls having a shape diverging from each other in a direction downstream with respect to the direction of flow of a stream of fluid issuing from said nozzle and opening outwardly in a direction away from said nozzle and at least the upstream portions thereof being curved; and a deflecting blade mounted in said assembly with the upstream and downstream edges respectively upstream and downstream of said nozzle and for rotation between a position perpendicular to the plane of the nozzle opening and first and second extreme positions on opposite sides of and at an angle to said perpendicular position and at which said blade is spaced from the nozzle defining structure for dividing the fluid medium flowing through said assembly into two fluid currents at all positions of said blade and, when the blade is in a position other than said perpendicular position, diverting the current on the side of the blade toward which the downstream end of the blade has been deflected, said guide walls being positioned sufficiently close to the path of the diverted current for causing the diverted current to adhere to the curved guide wall to which it has been diverted and to direct the current on the other side of said blade into said diverted current and then to facilitate adjoinment of both said currents to thereby control the direction of flow of the fluid stream emerging from said outlet means, the edge of the deflecting blade which is located upstream of the axis of rotation of the deflecting blade being so bent that, when the deflecting blade is rotated to one of the first and second extreme positions, the fluid medium flowing through the passageway is divided into the currents by said bent portion of the deflecting blade, whereby the rate of flow of one of the diverted current which subsequently adheres to the adjacent guide wall, is greater than that of the other of the currents.

14. A fluid deflecting assembly comprising: a nozzle means for issuing a main stream of fluid as the fluid passes therethrough, said nozzle means having a nozzle defining structure with a relatively small thickness in the direction of flow of fluid therethrough as compared with the width thereof in the direction at right angles to the direction of flow of the fluid therethrough; an outlet means through which the fluid emerges from said nozzle, said outlet means connected to said nozzle and being constituted by a pair of spaced opposed guide walls having a shape diverging from each other in a direction downstream with respect to the direction of flow of a stream of fluid issuing from said nozzle and opening outwardly in a direction away from said nozzle and at least the upstream portions thereof being curved; and a deflecting blade mounted in said assembly with the upstream and downstream edges respectively upstream and downstream of said nozzle and for rotation between a position perpendicular to the plane of the nozzle opening and first and second extreme positions on opposite sides of and at an angle to said perpendicular position and at which said blade is spaced from the nozzle defining structure for dividing the fluid medium flowing through said assembly into two fluid currents at all positions of said blade and, when the blade is in a position other than said perpendicular position, diverting the current on the side of the blade toward which the downstream end of the blade has been deflected, said guide walls being positioned sufficiently close to the path of the diverted current for causing the diverted current to adhere to the curved guide wall to which it has been diverted and to direct the current on the other side of said blade into said diverted current and then to facilitate adjoinment of both said currents to thereby control the direction of flow of the fluid stream emerging from said outlet means, one of the edge portions of the deflecting blade which is located downstream of the axis of rotation of the deflecting blade being so bent in a direction towards one of the guide walls that, when the deflecting blade is rotated to one of the first and second extreme positions in which the diverted current flows along said one of the guide walls, the width of the passage between the tip of said bent portion of the deflecting blade and said one of the corresponding guide walls is reduced to enhance the wall adherence effect of the current flowing therethrough, thereby increasing the angle of deflection of flow of the fluid stream emerging from said outlet means.

15. A fluid deflecting assembly comprising: a nozzle means for issuing a main stream of fluid as the fluid passes therethrough, said nozzle means having a nozzle defining structure with a relatively small thickness in the direction of flow of fluid therethrough as compared with the width thereof in the direction at right angles to the direction of flow of the fluid therethrough; an outlet means through which the fluid emerges from said nozzle, said outlet means connected to said nozzle and being constituted by a pair of spaced opposed guide walls having a shape diverging from each other in a direction downstream with respect to the direction of flow of a stream of fluid issuing from said nozzle and opening outwardly in a direction away from said nozzle and at least the upstream portions thereof being curved; and a deflecting blade mounted in said assemble with the upstream and downstream edges respectively upstream and downstream of said nozzle and for rotation between a position perpendicular to the plane of the nozzle opening and first and second extreme positions on opposite sides of and at an angle to said perpendicular position and at which said blade is spaced from the nozzle defining structure for dividing the fluid medium flowing through said assembly into two fluid currents at all positions of said blade and, when the blade is in a position other than said perpendicular position, diverting the current on the side of the blade toward which the downstream end of the blade has been deflected, said guide walls being positioned sufficiently close to the path of the diverted current for causing the diverted current to adhere to the curved guide wall to which it has been diverted and to direct the current on the other side of said blade into said diverted current and then to facilitate adjoinment of both said currents to thereby control the direction of flow of the fluid stream emerging from said outlet means, the opposite edges of the deflecting blade on respective sides of the axis of rotation of the deflecting blade being bent, the bent portion of the deflecting blade upstream of the axis of rotation of the deflecting blade being so shaped that, when the deflecting blade is rotated to one of the first and second extreme positions, the fluid medium flowing through the passageway is divided into the currents by said upstream bent portion of the deflecting blade, and the rate of flow of the diverted current, which subsequently adheres to the adjacent guide wall, is greater than that of the other of the currents, and the bent portion of the deflecting blade downstream of the axis of rotation of the deflecting blade is so shaped that, when the deflecting blade is rotated to one of the first and second extreme positions in which the diverted current flows along a corresponding one of the guide walls, the width of the passage between the tip of said downstream bent portion of the deflecting blade and said one of the guide walls is reduced to enhance the wall adherence effect of the current flowing therethrough, thereby increasing the angle of deflection of flow of the fluid stream emerging from said outlet means.

16. A fluid deflecting assembly of the type for confining the flow of fluid therethrough to flow in only two dimensions, said assemble comprising: a nozzle means for issuing a main stream of fluid as the fluid passes therethrough, said nozzle means having a nozzle defining structure with a relatively small thickness in the direction of flow of fluid therethrough as compared with the width thereof in the direction at right angles to the direction of flow of the fluid therethrough said nozzle defining structure having a pair of spaced opposed nozzle defining elements each having a configuration for causing the flow to tend to be deflected inwardly of the nozzle, and one of said nozzle defining elements being positioned upstream of the other of the nozzle defining elements with respect to the direction of flow of the fluid stream, an outlet means through which the fluid emerges from said nozzle, said outlet means connected to said nozzle and being constituted by a pair of spaced opposed guide walls having a shape diverging from each other in a direction downstream with respect to the direction of flow of a stream of fluid issuing from said nozzle and opening outwardly in a direction away from said nozzle and at least the upstream portions thereof being curved; and a deflecting blade mounted in said assembly with the upstream and downstream edges respectively upstream and downstream of said nozzle and for rotation between a position perpendicular to the plane of the nozzle opening and first and second extreme positions on opposite sides of and at an angle to said perpendicular position and at which said blade is spaced from the nozzle defining structure for dividing the fluid medium flowing through said assembly into two fluid currents at all positions of said blade and, when the blade is in a position other than said perpendicular position, diverting the current in the side of the blade toward which the downstream end of the blade has been deflected, said guide walls being positioned sufficiently close to the path of the diverted current for causing the diverted current to adhere to the curved guide wall to which it has been diverted and to draw the current on the other side of said blade into said diverted current and then to facilitate adjoinment of both said currents to thereby control the direction of flow of the fluid stream emerging from said outlet means.

17. A fluid deflecting assembly comprising: a nozzle means for issuing a main stream of fluid as the fluid passes therethrough, said nozzle means having a nozzle defining structure with a relatively small thickness in the direction of flow of fluid therethrough as compared with the width thereof in the direction at right angles to the direction of flow of the fluid therethrough; an outlet means through which the fluid emerges from said nozzle, said outlet means connected to said nozzle and being constituted by a pair of spaced opposed guide walls having a shape diverging from each other in a direction downstream with respect to the direction of flow of a stream of fluid issuing from said nozzle and opening outwardly in a direction away from said nozzle and at least the upstream portions thereof being curved; and a deflecting blade mounted in said assemble with the upstream and downstream edges respectively upstream and downstream of said nozzle and for rotation between a position perpendicular to the plane of the nozzle opening and first and second extreme positions on opposite sides of and at an angle to said perpendicular position and at which said blade is spaced from the nozzle defining structure for dividing the fluid medium flowing through said assembly into two fluid currents at all positions of said blade and, when the blade is in a position other than said perpendicular position, diverting the current on the side of the blade toward which the downstream end of the blade has been deflected, said guide walls being positioned sufficiently close to the path of the diverted current for causing the diverted current to adhere to the curved guide wall to which it has been diverted and to direct the current on the other side of said blade into said diverted current and then to facilitate adjoinment of both said currents to thereby control the direction of flow of the fluid stream emerging from said outlet means for detecting a change in the magnitude of a parameter in response to which the direction of flow of the fluid stream is desired to be changed, a drive source connected to said detecting means and responsive to a signal generated from said detecting means for producing a drive force for rotating the deflecting blade between said first and second extreme positions, and means for coupling said drive source to said blade.

18. A fluid diverting assembly as claimed in claim 14, wherein said bent portion of the deflecting blade is straight.

19. A fluid diverting assembly as claimed in claim 15, wherein both of said upstream and downstream bent portions of the deflecting blade are straight.

20. A fluid diverting assembly as claimed in claim 17, wherein said coupling means comprises means for disengaging the drive source from the deflecting blade.

21. A fluid diverting assembly as claimed in claim 1, further comprising means for providing a force for reciprocally swinging said deflecting blade between the first and second extreme positions, and means for coupling said swinging means to said deflecting blade.

22. A fluid diverting assembly as claimed in claim 21, wherein said coupling means comprises means for disengaging the swinging means from the deflecting blade.

23. A fluid diverting assembly as claimed in claim 1, wherein the length of the fluid diverting assembly as measured in a direction parallel to the direction of flow of the fluid stream is less than three times the width of the nozzle.

* * * * *